US008910821B1

(12) United States Patent
Stravitz

(10) Patent No.: US 8,910,821 B1
(45) Date of Patent: Dec. 16, 2014

(54) WASTE DISPOSAL DEVICES WITH WASTE TREATMENT COMPONENT

(71) Applicant: David M Stravitz, New York, NY (US)

(72) Inventor: David M Stravitz, New York, NY (US)

( * ) Notice: Subject to any disclaimer, the term of this patent is extended or adjusted under 35 U.S.C. 154(b) by 0 days.

(21) Appl. No.: 14/109,270

(22) Filed: Dec. 17, 2013

Related U.S. Application Data

(60) Provisional application No. 61/881,386, filed on Sep. 23, 2013.

(51) Int. Cl.
*B65B 9/10* (2006.01)
*B65F 1/16* (2006.01)
*B65F 1/06* (2006.01)

(52) U.S. Cl.
CPC .... *B65F 1/16* (2013.01); *B65F 1/06* (2013.01)
USPC ..... 220/495.08; 220/495.04

(58) Field of Classification Search
USPC ..... 220/495.06, 87.1, 522, 908.1, 810, 220/495.01–495.08; 423/261, 292, 300
See application file for complete search history.

(56) References Cited

U.S. PATENT DOCUMENTS

| | | | | | |
|---|---|---|---|---|---|
| 1,719,185 | A | * | 7/1929 | Lowy | 220/87.1 |
| 2,434,238 | A | | 1/1948 | Wolfson | |
| 2,793,373 | A | * | 5/1957 | Ewing | 241/46.016 |
| 3,214,065 | A | * | 10/1965 | Coward | 222/166 |
| 4,902,482 | A | | 2/1990 | Faust | |
| 5,174,462 | A | * | 12/1992 | Hames | 220/87.1 |
| D334,975 | S | * | 4/1993 | Bunce et al. | D23/366 |
| 5,520,303 | A | | 5/1996 | Bernstein et al. | |
| 5,988,520 | A | * | 11/1999 | Bitner | 239/6 |
| 6,540,103 | B2 | | 4/2003 | Silvers | |
| 6,612,099 | B2 | | 9/2003 | Stravitz | |
| 6,804,930 | B2 | | 10/2004 | Stravitz | |
| 6,851,251 | B2 | | 2/2005 | Stravitz | |
| 7,086,569 | B2 | | 8/2006 | Stravitz | |
| 7,114,314 | B2 | | 10/2006 | Stravitz | |
| 7,146,785 | B2 | | 12/2006 | Stravitz | |
| 7,225,943 | B2 | | 6/2007 | Yang et al. | |
| 7,316,100 | B2 | | 1/2008 | Stravitz et al. | |
| 7,434,377 | B2 | | 10/2008 | Stravitz et al. | |
| 7,503,152 | B2 | | 3/2009 | Stravitz et al. | |
| 7,503,159 | B2 | | 3/2009 | Stravitz et al. | |
| 7,516,865 | B1 | | 4/2009 | Pierre | |
| 7,543,716 | B2 | * | 6/2009 | Lin | 220/495.11 |
| 7,617,659 | B2 | | 11/2009 | Stravitz et al. | |
| 7,696,711 | B2 | * | 4/2010 | Pollack et al. | 318/466 |
| 7,708,188 | B2 | | 5/2010 | Stravitz et al. | |
| 7,712,285 | B2 | | 5/2010 | Stravitz et al. | |
| 7,878,359 | B1 | | 2/2011 | Ko | |

(Continued)

*Primary Examiner* — Anthony Stashick
*Assistant Examiner* — Ernesto Grano
(74) *Attorney, Agent, or Firm* — Brian Roffe

(57) ABSTRACT

Waste container includes a base defining a waste-receiving compartment and including a body and a closure component adapted to retain a membrane. The closure component includes a support portion defining an opening through which a bag is partly inserted into the compartment and then into which waste is insertable. The closure component is pivotally attached to the body to provide the compartment with either an open or closed position. The body includes a closure component support portion that supports the closure component. A lid is movably attached to the base and moves between a closed position covering the opening and an open position in which it does not obstruct the opening. A waste treatment component is arranged on an underside of the lid and is positioned to at least partly press against the membrane, when the membrane is present, when the lid is closed.

21 Claims, 26 Drawing Sheets

(56) References Cited

U.S. PATENT DOCUMENTS

| | | | | |
|---|---|---|---|---|
| 7,963,414 | B1 | 6/2011 | Stravitz | |
| 8,127,519 | B2 | 3/2012 | Stravitz | |
| 8,215,089 | B2 | 7/2012 | Stravitz | |
| 8,235,237 | B1 | 8/2012 | Stravitz | |
| 8,266,871 | B1 | 9/2012 | Stravitz | |
| 8,393,489 | B1 | 3/2013 | Stravitz | |
| 8,567,157 | B2 * | 10/2013 | Dunn et al. | 53/370 |
| 8,647,587 | B2 * | 2/2014 | Dunn et al. | 422/261 |
| 8,657,139 | B1 * | 2/2014 | Bodine | 220/87.1 |
| 8,690,017 | B2 * | 4/2014 | Dunn et al. | 222/166 |
| 8,739,501 | B2 * | 6/2014 | Dunn et al. | 53/284.7 |
| 2002/0051739 | A1 | 5/2002 | Wang | |
| 2008/0134644 | A1 * | 6/2008 | Knuth et al. | 53/459 |
| 2010/0005762 | A1 | 1/2010 | Stravitz | |
| 2011/0099958 | A1 * | 5/2011 | Dunn et al. | 53/567 |

* cited by examiner

WASTE DISPOSAL DEVICES WITH WASTE TREATMENT COMPONENT

CROSS-REFERENCE TO RELATED APPLICATION

This application claims priority of U.S. provisional patent application Ser. No. 61/881,386 filed Sep. 23, 2013, which is incorporated by reference herein.

FIELD OF THE INVENTION

The present invention relates generally to waste disposal device that may be used for any type of waste, including but not limited to, cat litter, medical waste from hospitals, doctors' offices, home health care personnel and facilities, nursing homes, biohazard laboratories, diapers, general household waste, disposables and the like.

BACKGROUND OF THE INVENTION

Waste disposal devices are common in hospitals, doctors' offices, kitchens and other household locations and other locations where waste is generated and must be disposed of in a sanitary manner. Waste disposal devices are also often used to dispose of household waste, cat litter and other pet waste. If the waste emits odors, the waste disposal device should also contain odors emanating from the waste.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237 and 8,266,871 all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a lid which is coupled to a rotation mechanism whereby upon forced manual closure of the lid, the rotation mechanism converts the manually-initiated closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

OBJECTS AND SUMMARY OF THE INVENTION

In order to achieve one or more of these objects, and possibly others, a waste container in accordance with the invention includes a base defining a waste-receiving compartment and including a body and an upper compartment closure component adapted to selectively retain a membrane. The upper compartment closure component includes a support portion defining an opening through which a bag is partly inserted into the compartment and then into which waste is insertable. The upper compartment closure component is pivotally attached to the body to provide a first position in which the compartment is accessible and a second position in which the compartment is closed. The body includes a closure component support portion that supports the upper compartment closure component when in the second position. The waste container also includes a lid movably attached to the base and that moves between a first position covering the opening and a second position in which it does not obstruct the opening, and an optional waste treatment component arranged on an underside of the lid and that can be positioned to at least partly press against the membrane, when present, when the lid is in its first position.

With respect to the waste treatment component, although generally any form of deodorizer, disinfectant, dispenser, air freshener or air purifier may be used, in a preferred embodiment, the waste treatment component includes a base having an attachment portion at an upper end at which the base is attached to the lid and a conduit portion at a lower end. The waste treatment component further includes a movable member having apertures that selectively align with one or more apertures in the conduit portion upon movement relative to the base. The lid may include two or more sets of projections and the base is attached to the lid by engaging the attachment portion between the sets of projections. The attachment portion may include apertures equal in number of one of the sets of projections that is radially outward of the attachment portion when the waste treatment component is attached to the lid. As such, the waste treatment component is rotatable to cause the projections to selectively expose or occlude the apertures on the attachment portion.

Another embodiment of the waste treatment component, which can be used as a stand-alone or independent unit, includes a base having an open upper end and defining a first compartment receivable of a first waste treatment material, a cover attached to the base to close the open upper end and a member movably attached to a lower end of the base to define a second compartment receivable of a second waste treatment material therebetween (which may be the same as or different than the first waste treatment material). The member includes at least one aperture on an exposed side to allow for release of the material in the second compartment. The base includes at least one optional aperture leading to the second compartment, as well as apertures leading to the exterior, to allow for release of the material in the first compartment.

The waste container optionally includes a membrane attached to the support portion of the upper compartment closure component and arranged in the opening. A preferred membrane is flexible and includes a central opening and a plurality of slots defining fingers. The membrane may be integral with the support portion or removably attached to the support portion. In one embodiment, the slots extend from the central opening to a periphery of the membrane and the membrane further comprises supplemental slots that extend radially inward from the periphery of the membrane close to but separated from the central opening.

In one embodiment, the closure component support portion includes an inwardly projecting lip on which a peripheral edge of a planar portion of the support portion of the upper compartment closure component rests when in the second position. It is also possible that the support portion of the upper compartment closure component includes a peripheral wall having at least one cut-out portion to facilitate movement of the upper compartment closure component from the second position to the first position. The compartment closure component receives bags without the need for inner liners commonly used in waste receptacles. This simplifies the usual struggle to wrap the bag around the liner and carefully then insert it into the pail, which tends to be messy and provide inconsistent results.

A hoop may secure the bag to the upper compartment closure component. The hoop may be pivotally attached to the upper compartment closure component, or totally separate therefrom.

The waste container may also be provided with a depressible pedal coupled to the lid for controlling movement of the lid between the first and second positions.

The base of the waste container may include a door on a side that provides access to the compartment, and which includes a window made of a clear or transparent material.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
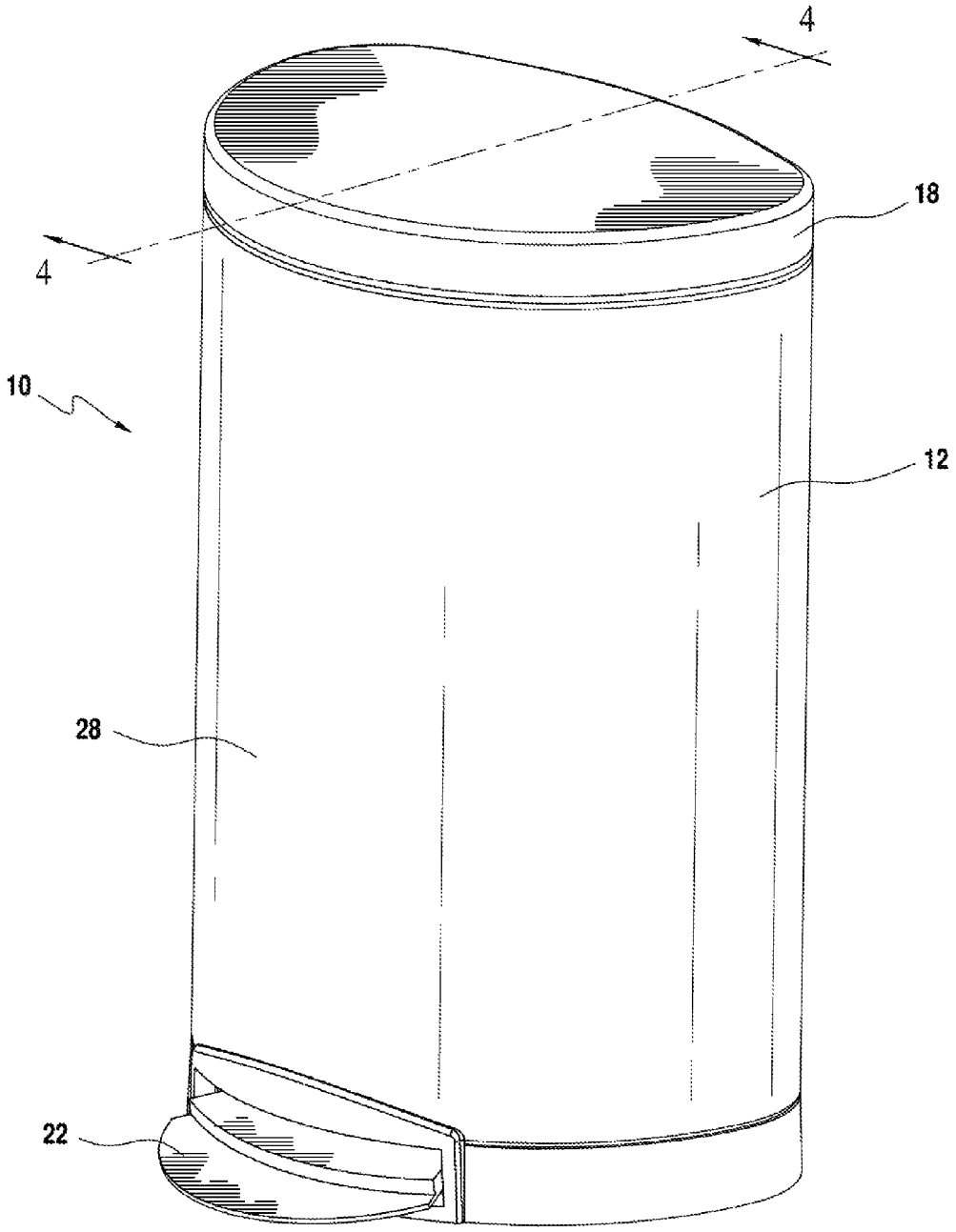
FIG. 1 is a perspective view of a first embodiment of a waste container in accordance with the invention shown with its lid in a closed state.

Referring to the accompanying drawings wherein like reference numerals refer to the same or similar elements, a first embodiment of a waste container in accordance with the invention is shown in FIGS. 1-6 and is designated generally as 10. Container 10 includes a base 12 defining a waste-receiving compartment 14 and an opening 16 communicating with the waste-receiving compartment 14 (see FIGS. 4 and 5). A lid 18 is movably attached to the base 12 and moves between a first position covering the opening 16, i.e., prevents insertion of waste into the waste-receiving compartment 14 (see FIG. 4) and a second position in which it does not obstruct the opening 16, i.e., enables insertion of waste (see FIG. 2).

The lid 18 may be pivotally mounted to a rear, upper edge of the base 12 by any type of pivotal mounting mechanism 20. Generally, the pivotal mounting mechanism 20 would include one or more parts on the base 12 and one or more cooperating parts on the lid 18. Instead of a pivotal mounting mechanism, another type of mechanism that enables the lid 18 to move while mounted to the base 12 between a closed position shown in FIG. 1 and an open position shown in FIG. 2 may be used in the invention, including any known to those skilled in the art of waste containers. Such a mechanism will be referred to herein as a lid mounting mechanism or lid mounting means.

Figure 2:
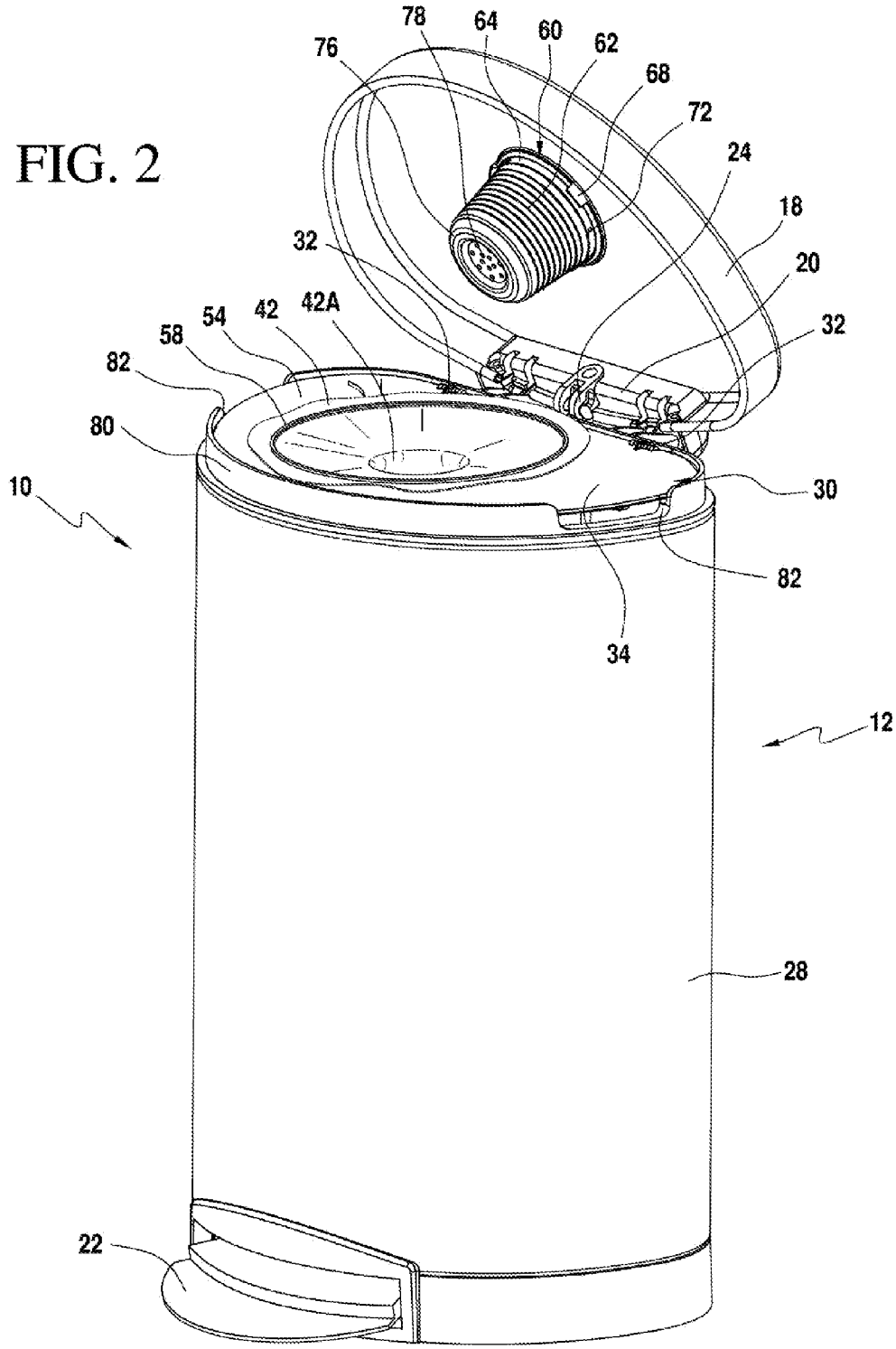
FIG. 2 is a perspective view of the waste container shown in FIG. 1 with its lid in an open and ready-for-use state.

Container 10 also includes a depressible pedal 22 that is coupled to the lid 18 and controls movement of the lid 18 between the closed position shown in FIG. 1 and the open position shown in FIG. 2. As shown, pedal 22 is a foot pedal having a first, undepressed state shown in FIG. 1 wherein it is slightly elevated from a plane defined by the lower surface of the base to enable depression thereof. When depressed into the state shown in FIG. 2, the coupling between the foot pedal 22 and the lid 18 causes the lid 18 to open. When pressure on the foot pedal 22 is released, the lid 18 closes. This coupling between the foot pedal 22 and the lid 18 to convert depression of the foot pedal 22 into opening movement of the lid 18 may be any coupling used in containers known to those skilled in the art. A portion of this coupling mechanism, also referred to as coupling means herein, is shown at 24 in FIGS. 2 and 3, and includes a horizontal actuating member 26 shown in FIG. 4. The coupling mechanism may be as described in U.S. Pat. No. 8,393,489 (Stravitz), incorporated by reference herein.

Figure 3:
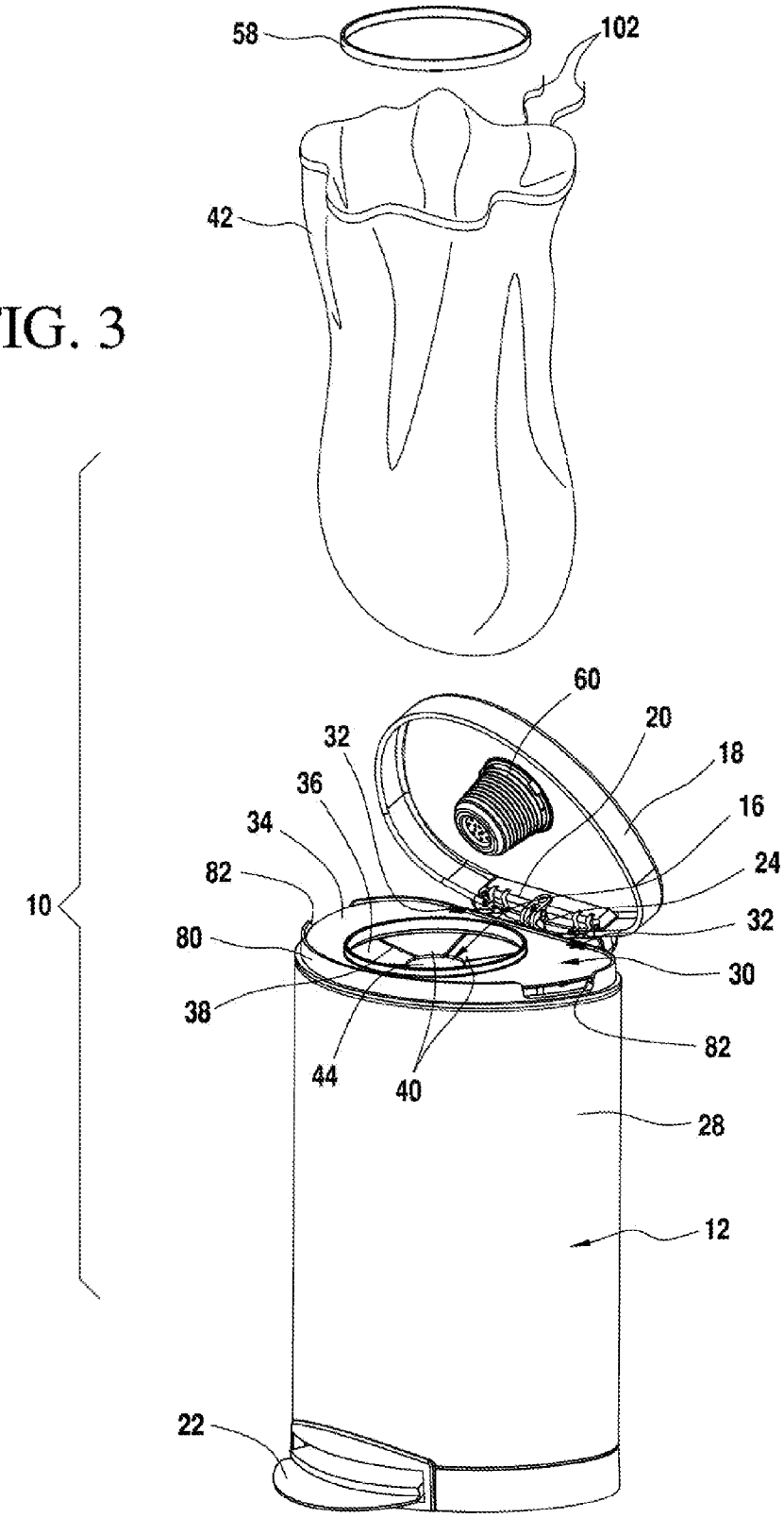
FIG. 3 is a perspective view of the waste container shown in FIG. 1 with its lid in an open state and a bag assembly separated from the container.
Figure 6:
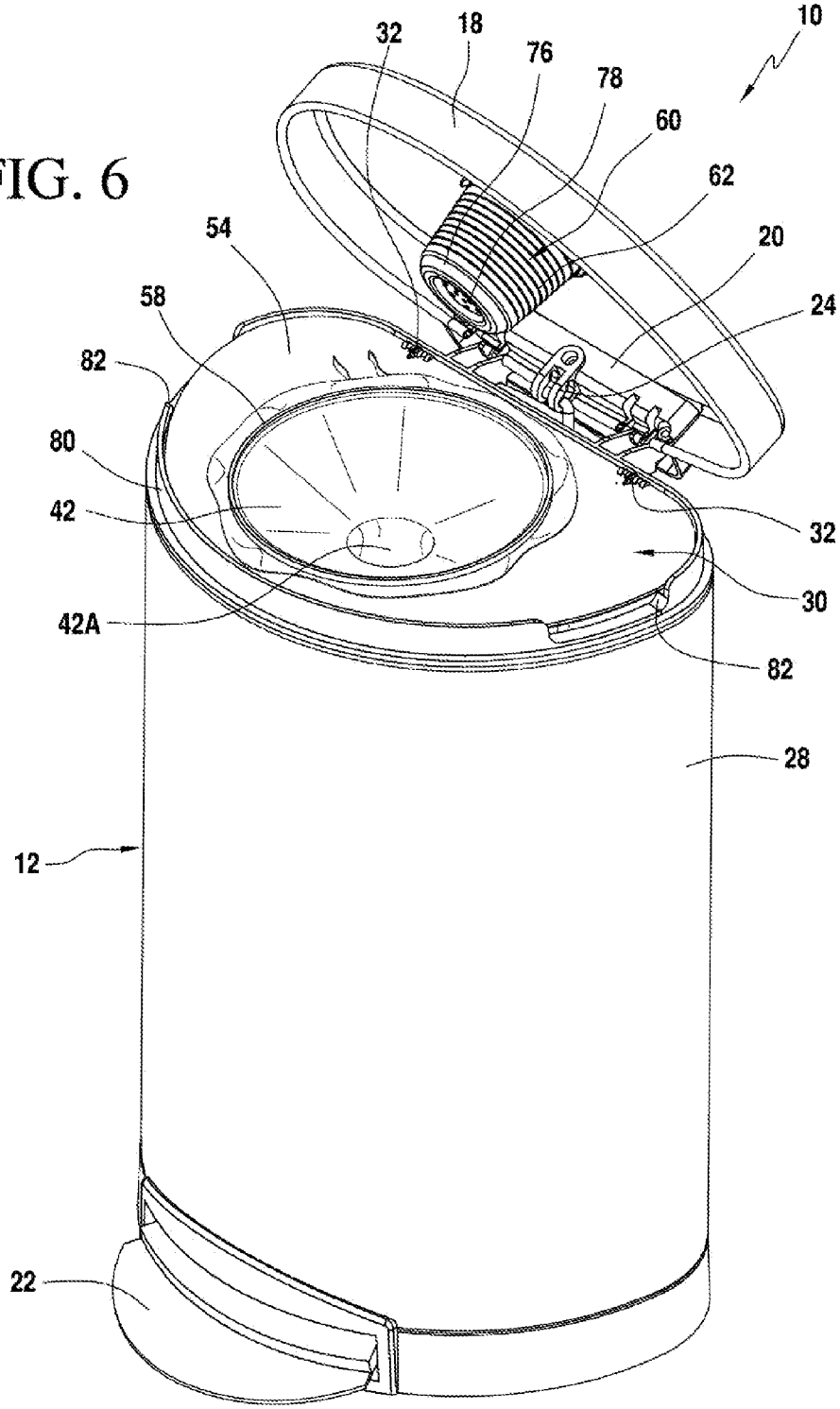
FIG. 6 is another perspective view of the container shown in FIG. 1.

Base 12 includes a body 28 and an upper compartment closure component, or closure component 30 pivotally attached to the body 28. To this end, a pivotal attachment mechanism or pivotal attachment means is arranged along a rear edge of the base 12 and includes one or more parts arranged on the closure component 30 and one or more complementary parts arranged on the body 28. For example, the pivotal attachment means may comprise two hinges 32 as shown in FIGS. 3 and 6, with one part of each hinge 32 being situated on or attached to the body 28 and the other, complementary part of each hinge 32 being situated on or attached to the closure component 30 to enable the closure component 30 to pivot about an axis substantially perpendicular to a vertical axis of the container 10. Other mechanisms and means that enable pivotal movement of one part relative to another may be used in the invention.

Closure component 30 includes a support portion 34 that generally has the same cross-sectional shape as the cross-sectional shape of the container 10 parallel to a surface on which the container 10 rests. Support portion 34 defines the opening 16 of the container 10. Closure component 30 also optionally includes or retains a membrane 36 that is situated in the opening 16 and may be releasably or permanently attached to the support portion 34.

Figure 26:
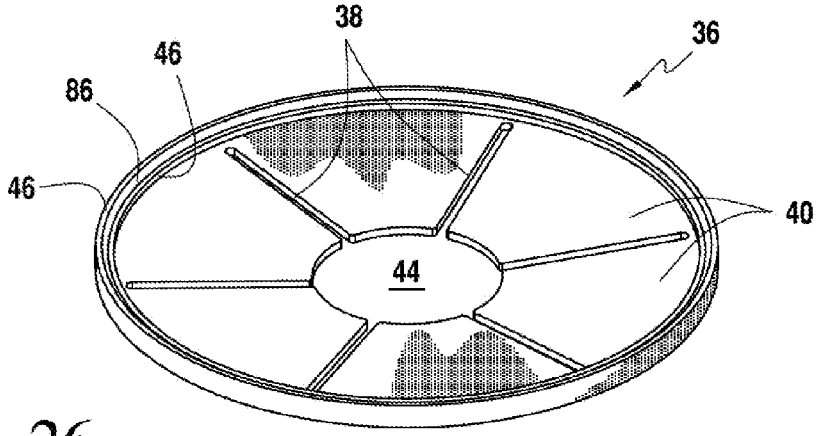
FIGS. 26-28 shows various membranes used with the waste containers in accordance with the invention.

Membrane 36 includes a plurality of slots 38 between fingers 40 of the membrane 36, and specifically six slots 38 (see FIGS. 3 and 26). The slots 38 provide the membrane 36 with flexibility to enable insertion of waste into a bag 42 that overlies the membrane 36 with a portion of the bag 42 being passed through a central opening 44 of the membrane 36.

More specifically, the bag 42 overlies the membrane 36 to define a bag aperture 42A which forms at the central opening 44 of the membrane 36 (see FIG. 2). This bag aperture 42A is exposed when the lid 18 is pivoted upward relative to the base 12, e.g., by depressing the foot pedal 22 (see FIG. 6). The bag aperture 42A is covered when the lid 18 is closed, i.e., upon releasing pressure on the foot pedal 22, and may also be closed by means of a waste treatment component 60 or 110, described more fully below, when such a waste treatment component is present.

The membrane 36 may be formed and constructed in different ways and is not limited to the presence of six fingers 40 separated by six slots 38 as in the illustrated embodiment (see FIG. 26). The material of the fingers 40 may be selected to be flexible so that they flex downward in a direction away from the center when a person pushes waste through the central region of the membrane 36. The material of the fingers 40 should also be resilient so that the fingers 40 return to their initial form after the person has removed their hand from engagement with the membrane 36, or the inserted waste has been pushed downward through the membrane 36 and is no longer in engagement therewith.

For example, the membrane 36 may be made of silicone or another rubbery material. It may also be made of a flexible synthetic material which flexes under pressure and returns when pressure is removed. The edges of the fingers 40 which are expected to engage the bag 42 may be provided with a friction-enhancing material to increase the contact force between the fingers 40 and the bag 42.

Furthermore, the membrane 36 is preferably molded in a resilient substrate that can be adjusted for proper rigidity depending on the application. Polypropylene is one such material. The membrane 36 can also be reinforced with some ribbing to give it strength to return substantially to its relaxed shape. The membrane opening 44, 44A and 44B of membranes 36, 36A and 36B, respectively, shown in FIGS. 26-28 may have smaller apertures for specific applications, for example, when not using the waste treatment component 60, 110 to seal off the bag opening 42A that aligns with the membrane opening 44, 44A, 44B.

Membrane 36 may be formed integral with the support portion 34 to provide a unitary closure component 30 or separate therefrom and then attached thereto. For example, as shown in FIGS. 4 and 5, the membrane 36 includes an upwardly facing channel 86 defined between two walls 46 (see also, FIGS. 26-28) and the support portion 34 includes two support walls 48 separated by a channel 50 (see also, FIG. 14), all of which are dimensioned such that one wall 46 of the membrane 36 securely fits into the channel 50 of the support portion 34 and one wall 48 of the support portion 34 securely fits into the channel 44 of the membrane 36.

Figure 4:
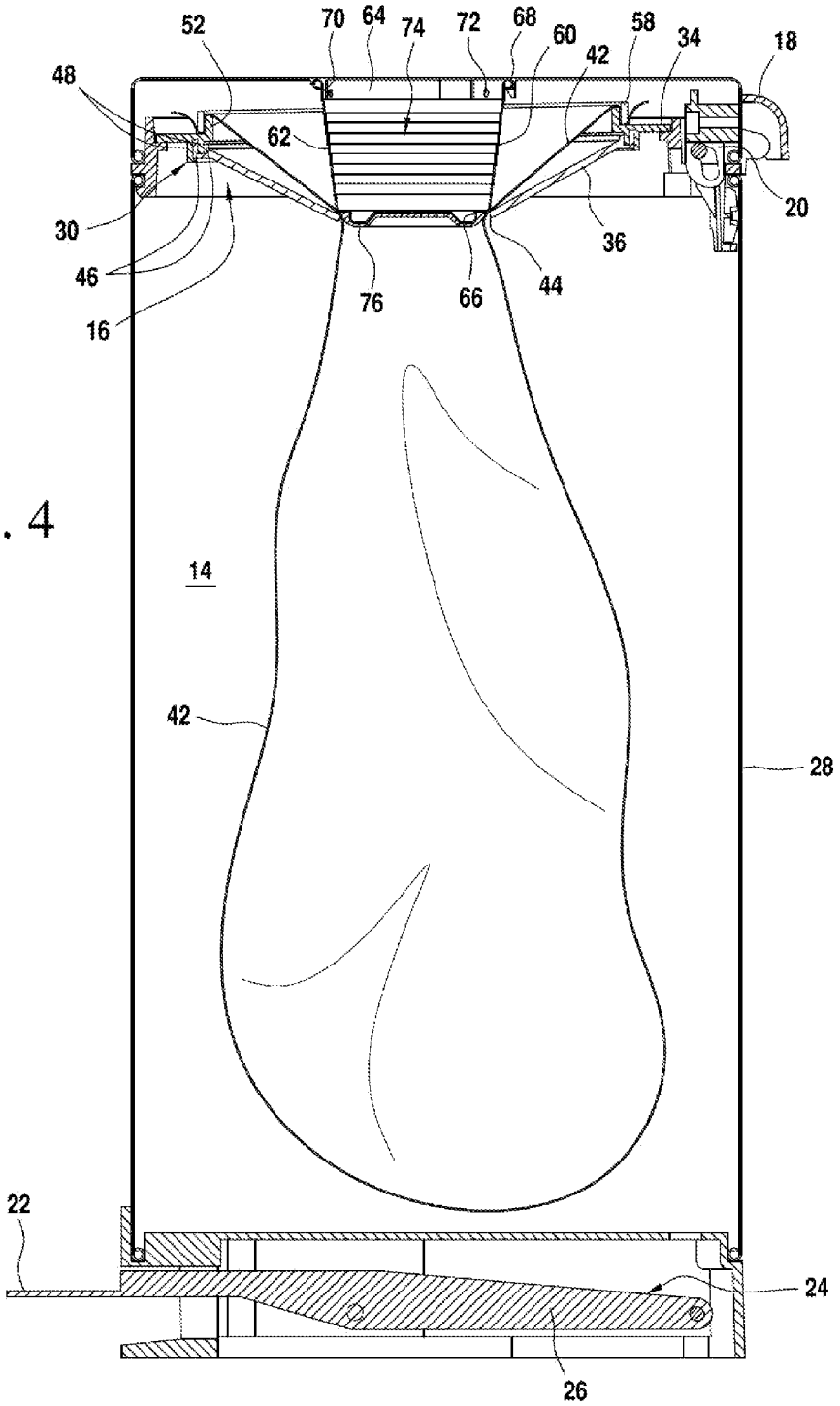
FIG. 4 is a cross-sectional view of the container shown in FIG. 1 taken along the line 4-4- in FIG. 1.
Figure 5:
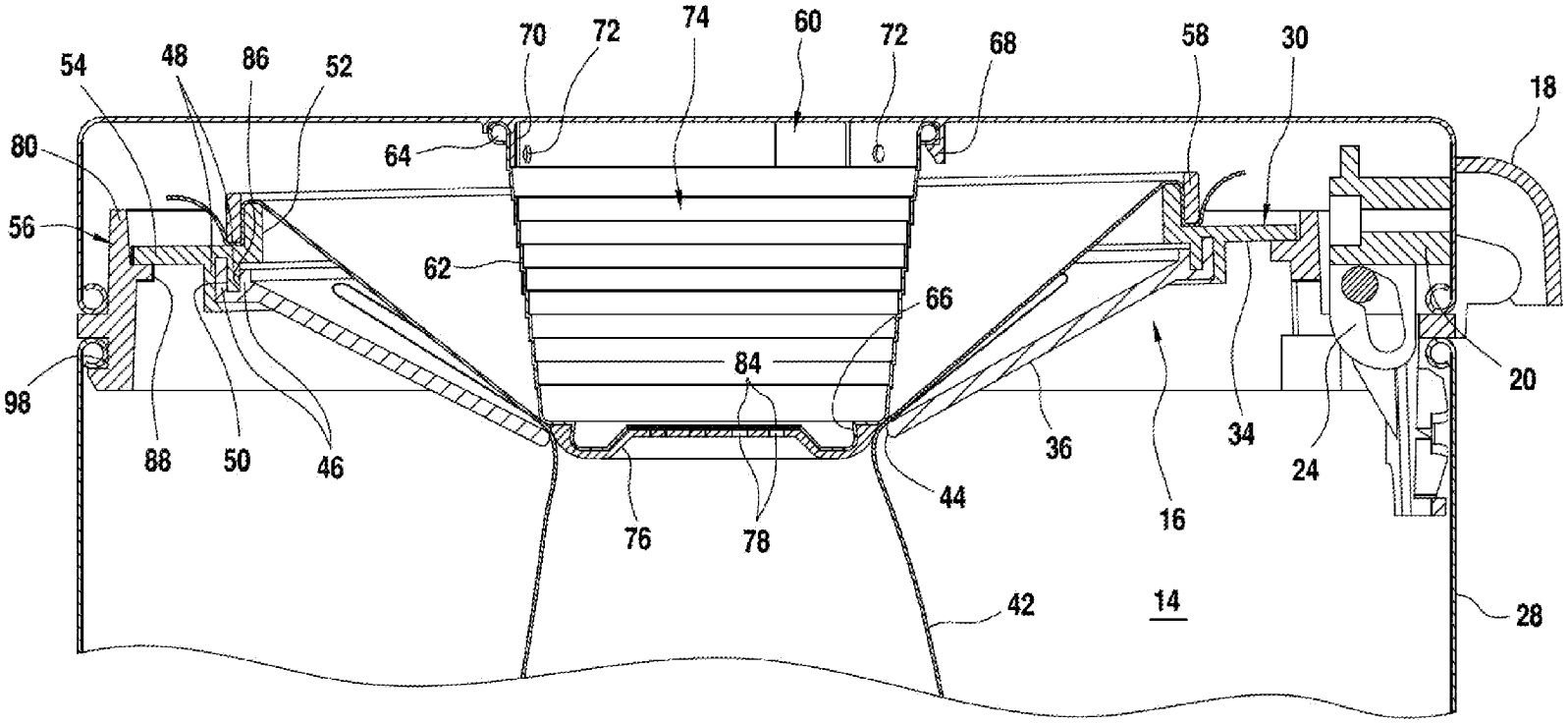
FIG. 5 is an enlarged view of the upper portion of FIG. 4.

The support portion 34 also includes a wall 52 that projects from a planar portion 54 and over which the bag 42 is placed (see FIGS. 4 and 5).

The body 28 of the base 12 includes a closure component support portion 56 that includes an inwardly projecting lip 88 on which a peripheral edge of the planar portion 54 of the support portion 34 rests when the closure component 30 is in its use position (shown in FIGS. 4 and 5). Closure component support portion 56 may be formed integral with a remaining portion of the body 28 or separate therefrom and then attached thereto. In the latter case, the closure component support portion 56 may be formed with a channel 98 that receives a rim at the upper edge of the remaining portion of the body 28 (see FIG. 5). Also, closure component support portion 56 includes a peripheral wall 80 that has one or more cut-out portions 82 (see FIGS. 2 and 3). The purpose of the cut-out portion(s) 82 is to facilitate lifting of the support portion 34, causing it to pivot relative to the body 28 of the base 12 and thereby enable access to a bag of waste in the compartment 14.

Another element of the container 10 is a hoop 58 that secures the bag 42 to the closure component 30. Hoop 58 has the same shape as the projecting wall 52 of the support portion 34 of the closure component 30 and is dimensioned relative thereto, i.e., with its inner circumference slightly larger than the outer circumference of the projecting wall 52, to provide a tight fit of the bag 42 therebetween (see FIGS. 4 and 5). This tight fit secures the bag 42 to the container 10 and should prevent unintentional release of the bag 42 from engagement with the container 10. The hoop 58 may be retained when not in use on the underside of the lid 18, e.g., by providing a securing or attachment mechanism such as clamps, on the underside of the lid 18. This will prevent loss of the hoop 58, yet ensure that the hoop 58 is readily available when it is desired to use it (note that the waste container 58 may be used with or without the hoop 58). As an alternative, the hoop 58 may be attached to the closure component 30, as described below with reference to FIG. 30.

Container 10 also includes a waste treatment component 60 that is positioned on the underside of the lid 18 (see FIGS. 2-6 and 23). Waste treatment component 60 includes a base 62 having an attachment portion 64 at an upper end and a conduit portion 66 at a lower end (see FIGS. 5 and 23). Attachment portion 64 may comprise an enlarged rim that is designed to be positioned between projections 68, 70 on the underside of the lid 18. Projections 68 are designed to be positioned radially outward of the attachment portion 64 (as shown in FIG. 2) and projections 70 are designed to be positioned radially inward of the attachment portion 64 (as shown in FIG. 5), when the attachment portion 64 is engaged with the lid 18. In this manner, the attachment portion 64 is snapped onto the lid 18, although other mechanisms and means for removably securing the base 62 to the lid 18 are encompassed within the scope of the invention. Projections 68, 70 are flexible and each includes a ramped portion that facilitates insertion of the waste treatment component 60 into engagement with the projections 68, 70. Removal of the waste treatment component 60 from the lid 18 involves flexing one or more of the projections 68 outward and pulling the waste treatment component 60 away from the lid 18.

Also, attachment portion 64 includes apertures 72 that are preferably equal in number to the projections 68 and have the same circumferential spacing as the projections 68. In this manner, the waste treatment component 60 may be rotated to a position in which the projections 68 cover the apertures 72, and thereby prevent release of deodorant, air freshener, air purifier, or disinfectant from an interior cavity 74 of the waste treatment component 60 to the space between the bag 42 and the lid 18, or allow for release of deodorant or disinfectant from the interior cavity 74 of the waste treatment component 60 to the space between the bag 42 and the lid 18. Rotation of the waste treatment component 60 can be effected manually depending on whether the user of the container 10 determines that there is a need to address unpleasant smells and odors between the bag 42 and the lid 18 or disinfect this area. Rotation of waste treatment component 60 therefore controls the degree to which deodorant or disinfectant is released into the space between the lid 18 and bag 42.

The base 62 tapers in a downward direction toward the bottom of the base 12 of the container 10, and preferably is provided with a vertical height such that is slightly presses against the bag 42 at a location at or around where the bag 42 contacts the membrane 36 (see FIGS. 4 and 5). The outer surface of the base 62 has staggered edges that assist in scraping clean bag 42 when the lid 18 is closed. The outer surface of the base 62 may be provided with a smooth tapering edge, or any other form or type of edge instead of the staggered edge. Otherwise, the base 62 is preferably formed such that when the lid 18 is closed, it forms a seal against the bag 42 around the bag opening 42A.

In a preferred embodiment, the waste treatment component 60 is dimensioned so that when the lid 18 is closed, the waste treatment component 60 presses the membrane 36 slightly inward causing it to flex. This flexure serves to provide a seal to the bag 42, i.e., that portion of the bag 42 containing waste in the compartment 14 is sealed by the pressure contact between the membrane 36 and the waste treatment component 60. One of the seal's purposes is to minimize or prevent the backdraft of odor, airborne bacteria and/or fungus from escaping the waste contained inside the waste containing bag 42.

The waste treatment component 60 may house one or more of a deodorant, a disinfectant, an air freshener, an air purifier, a compound that neutralizes odor, a compound that neutralizes bacteria, and a compound that neutralizes fungus. These compounds may be solid, liquid or in powder form.

Figure 23:
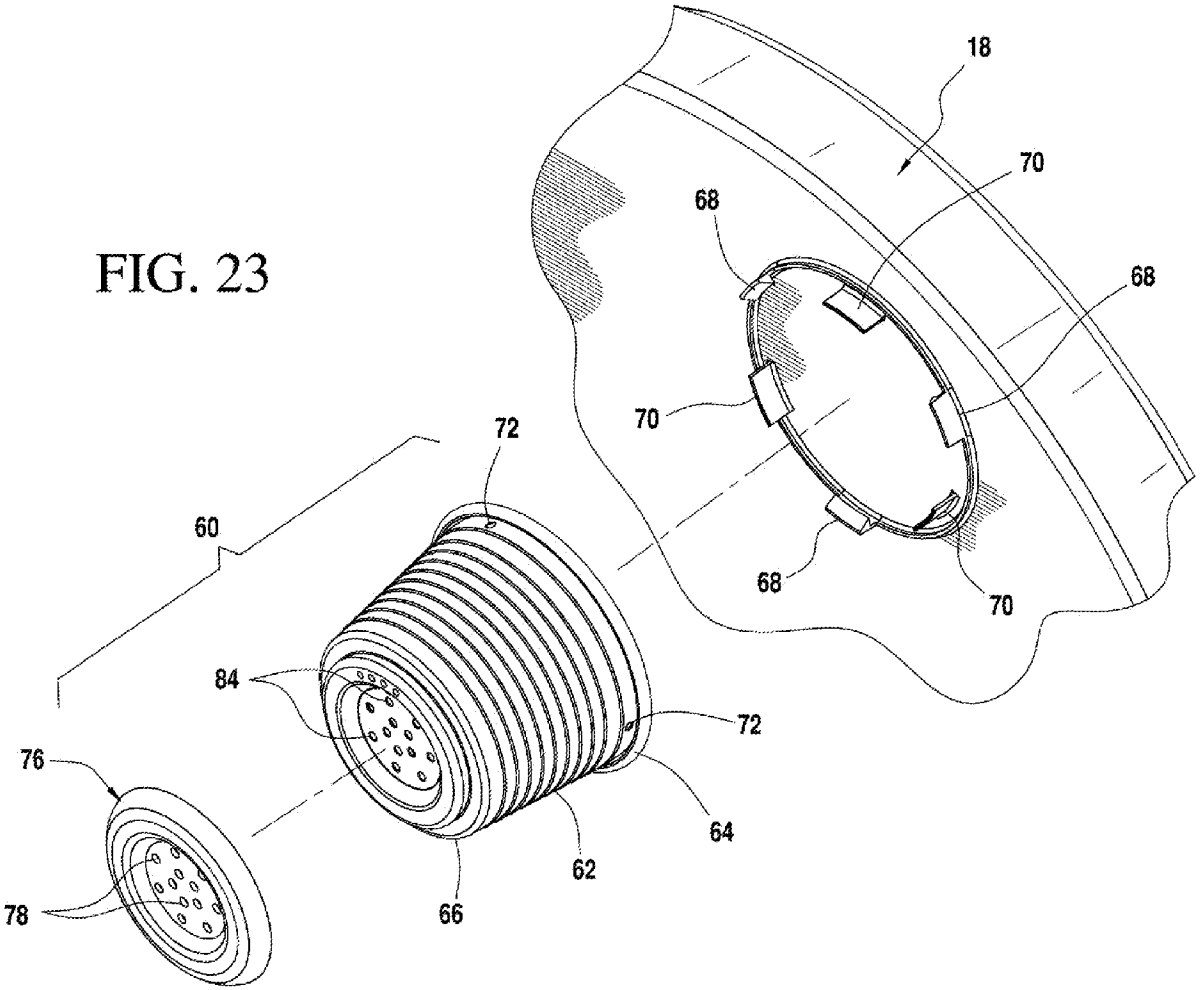
FIG. 23 is an exploded perspective view of a first embodiment of a waste treatment component used with a container in accordance with the invention.

Conduit portion 66 is formed as the bottom of the base 62 and includes a plurality of apertures 84 through which deodorant or disinfectant from the interior cavity 74 of the waste treatment component 60 is released to the interior of the bag 42 (see FIG. 23). However, this release is again controlled by the user by attaching a rotatable member 76 to the base 62 to selectively cover or expose the apertures 84 (see FIG. 23). This attachment may be a snap-on type of attachment, or similar. Rotatable member 76 includes apertures 78 that either align with apertures 84 on the conduit portion 66 or solid portions of the conduit portion 66 (see FIG. 5 whereon two apertures 84 align with two respective apertures 66 while other aperture 84 align with a solid portion of the conduit portion 66). Rotation of member 76 therefore controls the degree to which deodorant or disinfectant is released into the bag 42.

Member 76 may be positioned to facilitate pushing of waste through the central opening 44 of the membrane. To this end, the waste treatment component mounting mechanism, i.e., projections 68, 70, are preferably positioned to align the member 76 with the central opening 44 of the membrane 36. Thus, during use of the container 10, any waste that is lodged in the bag 42 around the central opening 44 of the membrane 36 will be pushed by waste treatment component 36 into the portion of the bag 42 in the compartment 14 when the lid 18 is closed. In addition or alternatively, the member 76 will abut against the bag 42 around the opening 42A and seal the bag opening 42A, i.e., at least partly press against and/or make contact with the bag 42. The waste treatment component 60 therefore performs bag sealing, waste insertion and waste treatment.

Instead of a removal mounting mechanism for the waste treatment component 60, a waste treatment component may be permanently attached to the underside of the lid 18. It could thus be formed integral with the lid 18 and configured to allow for insertion of a new deodorant, disinfectant, etc., e.g., with a removable cartridge, access door, and the like.

Different constructions of a waste treatment component 60 are envisioned. In one embodiment, the waste treatment component 60 is a disposable, single-use deodorizer and/or disinfectant and must be replaced by a completely new deodorizer and/or disinfectant once the deodorant and/or disinfectant in the interior cavity 74 is used up. In another embodiment, the waste treatment component 60 is designed for multiple uses and allows for insertion of blocks or pellets of deodorant or disinfectant into the interior cavity 74 upon disengagement of the waste treatment component 60 from the lid 18.

Waste treatment component 60 may also be considered a canister. The canister may be made with two interior cavities, one including a disinfectant and one including a deodorant. The cavity including the disinfectant may communicate with the apertures 72 in the attachment portion 64. The cavity including the deodorant may communication with the apertures 84 in the conduit portion 66.

In use, the container 10 is placed into a use state by obtaining a bag 42, lifting the lid 18 into the state shown in FIG. 3, pushing the bag 42 through the central opening 44 of the membrane 36 into the compartment 14 and placing the upper flange of the bag 42 over the projecting wall 52 of the support portion 34 of the closure component 30. Then, the hoop 58 is placed around the projecting wall 52 to sandwich part of the bag 42 between the hoop 58 and the projecting wall 52 (providing the container 10 with the state shown in FIG. 2). The bag 42 may optionally be tied at its open end by ties or a drawstring 102 (see FIG. 3), although such tying may usually occur when the full bag 42 is removed from the container 10. The container 10 is ready for use.

For use, the lid 18 is opened by depressing the foot pedal 22 and waste is then pressed against the bag 42 in that portion overlying the membrane 36 until the waste is pressed past the membrane 36 into the compartment 14 (see FIG. 4 in which the bag 42 in the compartment 14 may contain one or more waste insertions). The lid 18 is then closed, e.g., by releasing pressure on the foot pedal 22. As desired, the rotatable member 76 and base 62 are manipulated to cause release of deodorant or disinfectant from the interior cavity 74 of the waste treatment component 60 into the bag 42 and/or into the space between the bag 42 and the lid 18.

Figure 22:
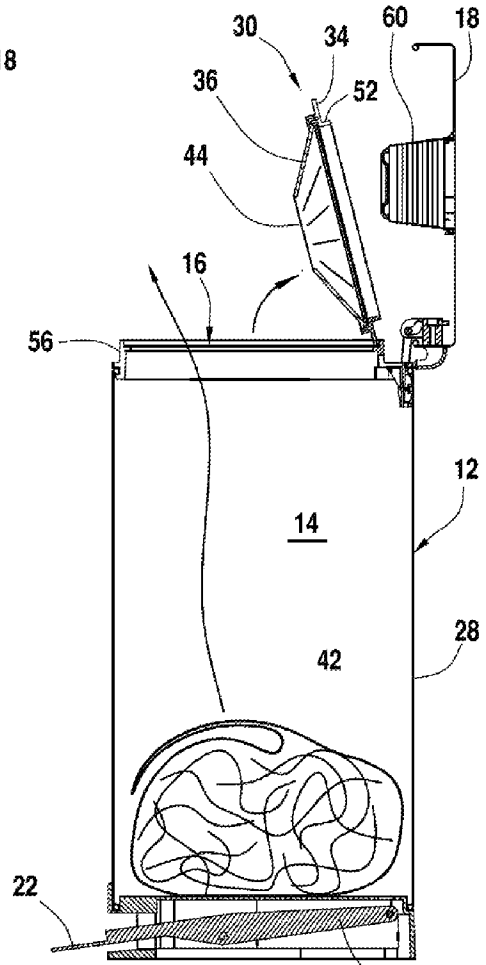
FIGS. 20-22 show different stages in use of the waste container shown in FIG. 1 including stage during removal of a bag from the container.
Figure 21:
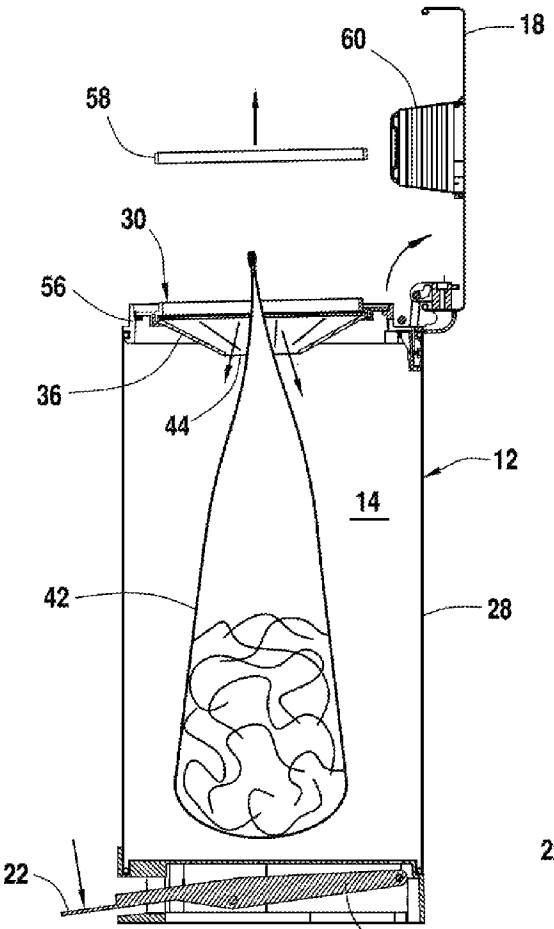
Figure 20:
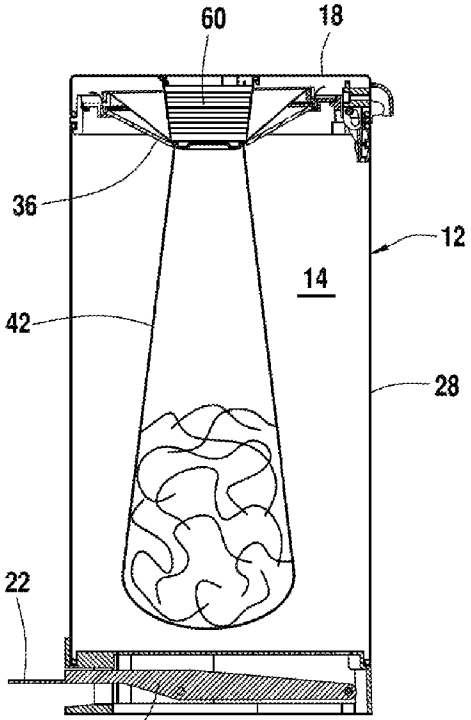

Referring now to FIGS. 20-22, when the bag 42 is full and it is desired to remove the bag 42 from the container 10 (as shown in FIG. 20), the lid 18 is lifted up by depressing the foot pedal 22, the hoop 58 is lifted up (FIG. 21) and the flange of the bag 42 inserted through the central opening 44 of the membrane 36 (see the arrows in FIG. 21 which represent this movement). The closure component 30 is lifted up (see FIG. 22) and then the flange of the bag 42 is tied or otherwise closed, e.g., with a drawstring or a bag tie known to those skilled in the art. Alternatively, the flange of the bag 42 is tied or otherwise closed before the closure component 30 is lifted up (in the position shown in FIG. 21). The full bag 42 is then lifted out of the compartment 14 (see FIG. 22) and the closure component 30 then moved back into engagement with the base 12 and readied for insertion of a new bag 42.

Figure 7:
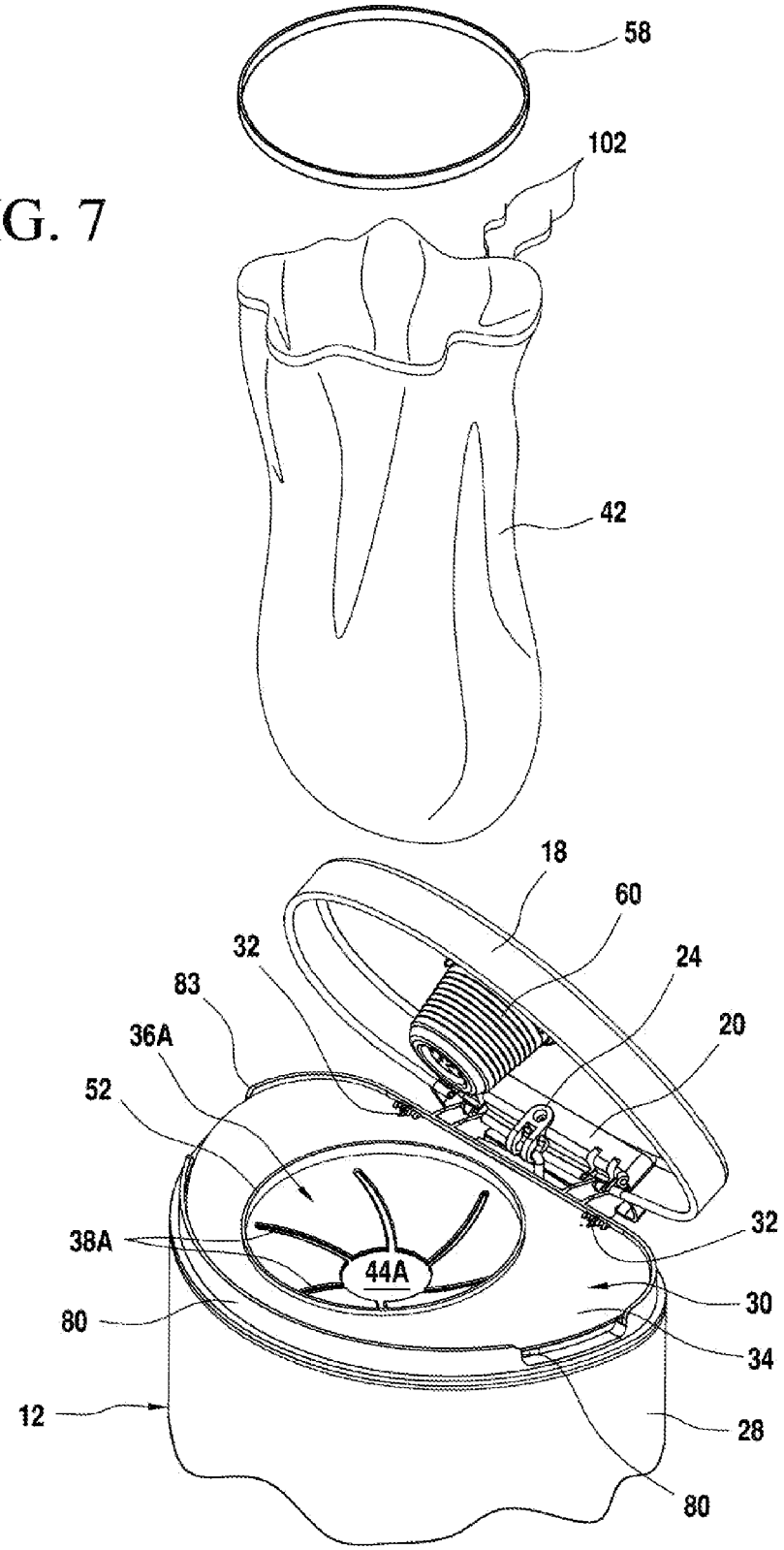
FIG. 7 is a perspective view of another embodiment of a waste container including a different membrane than that shown in FIG. 3.
Figure 8:
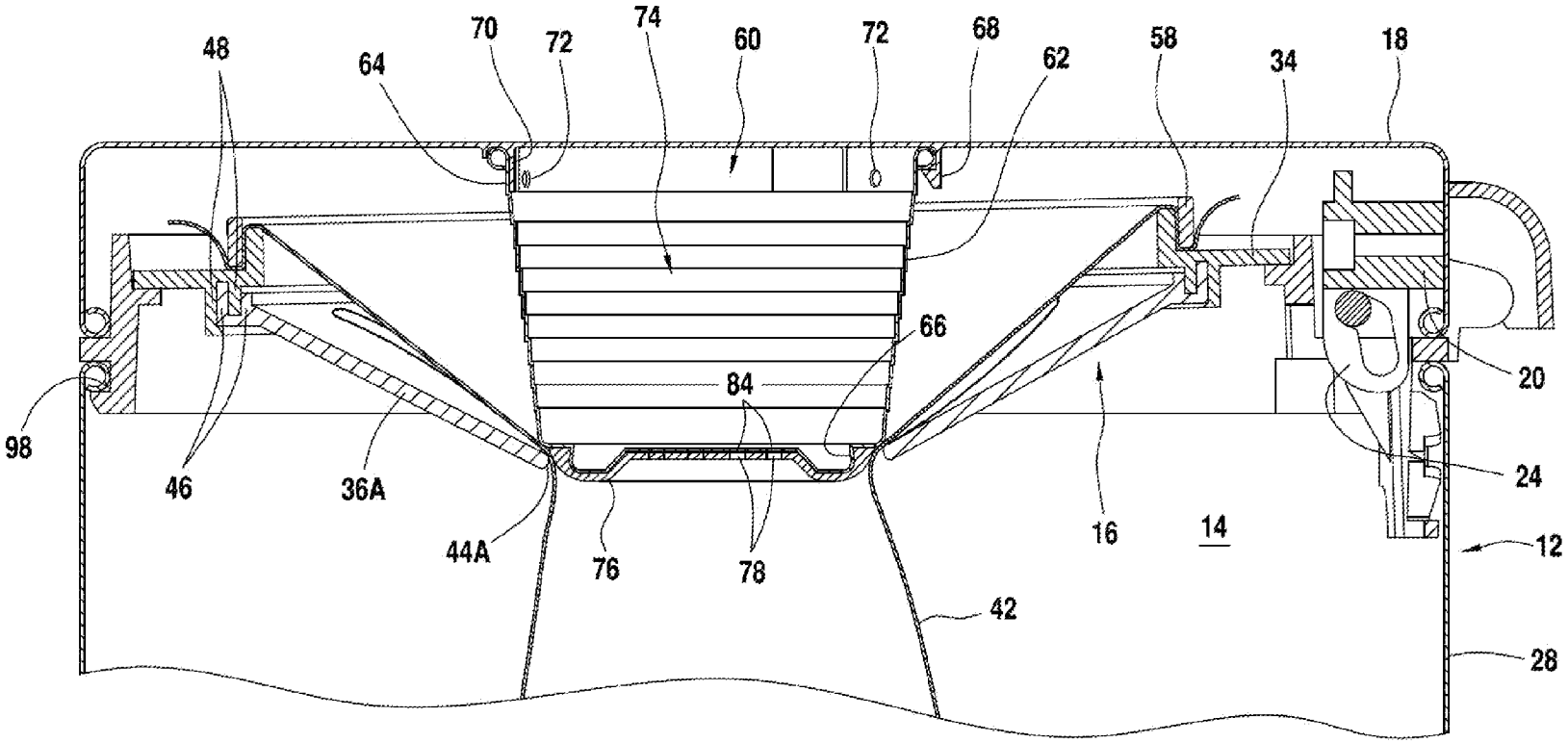
FIG. 8 is a cross-sectional view of a portion of the container shown in FIG. 7.
Figure 27:
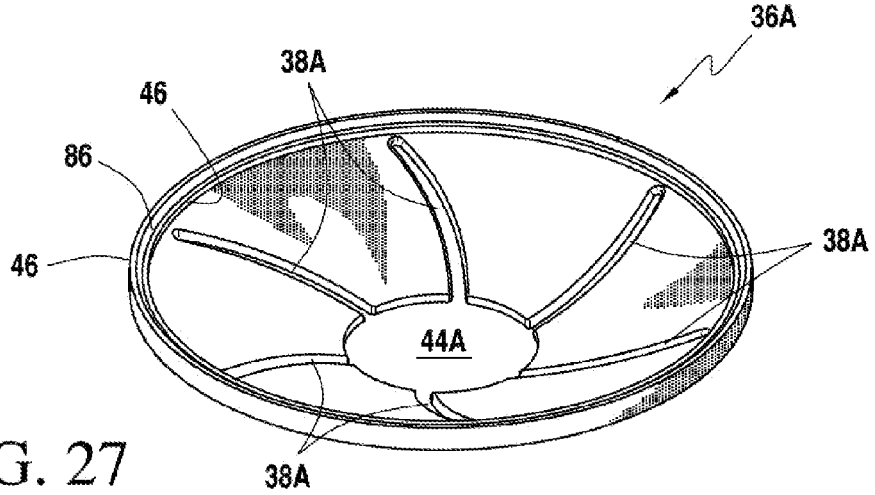

FIGS. 7 and 8 show another embodiment of container 10 with a different membrane 36A (also shown in FIG. 27). Membrane 36A has six curved slots 38A leading from the central opening 44A. Otherwise, the container with membrane 36A is used in the same manner as container 10 and membrane 36A may have the same characteristic and properties as membrane 36.

Figure 9:
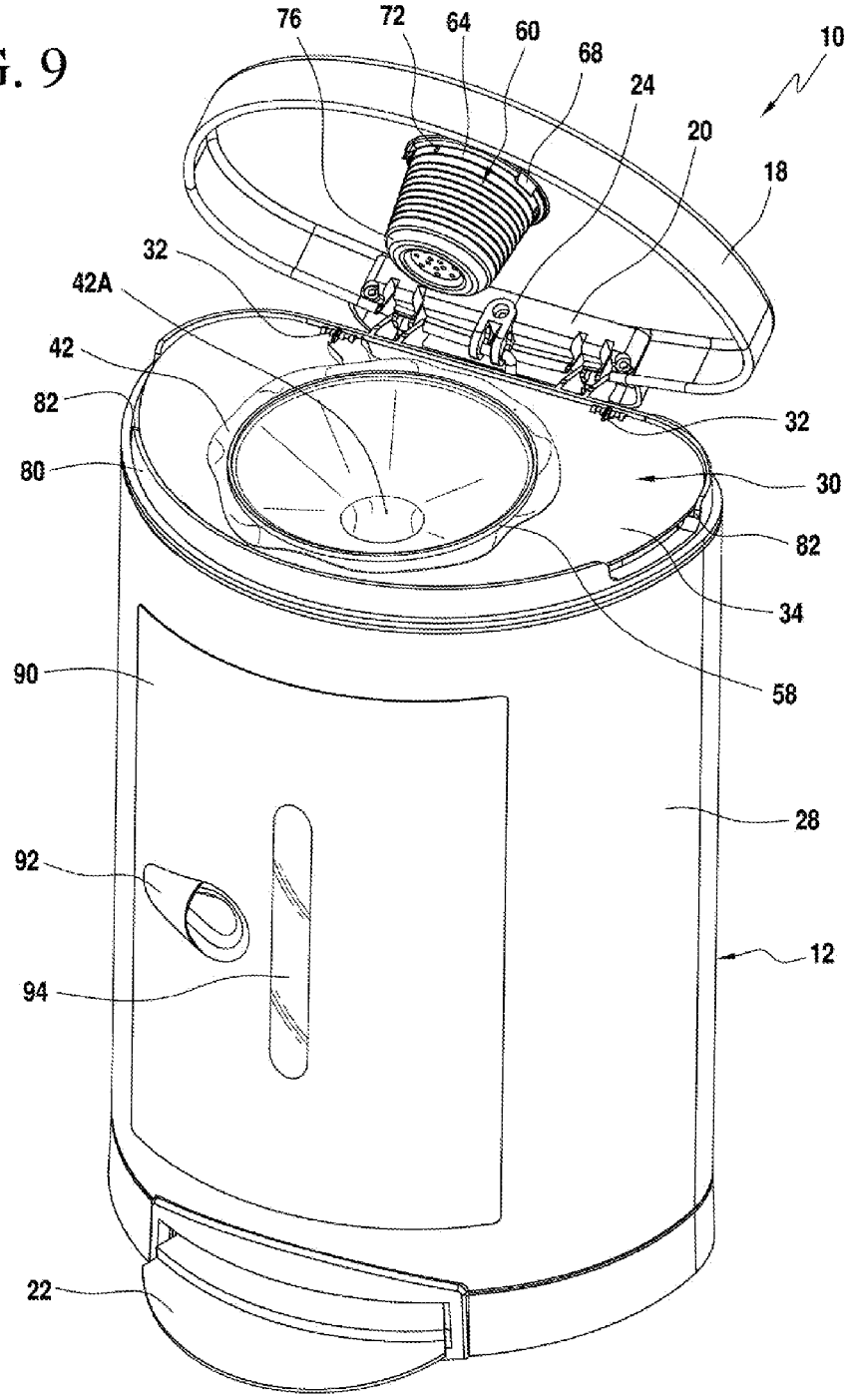
FIG. 9 is a perspective view of another embodiment of a waste container in accordance with the invention.
Figure 10:
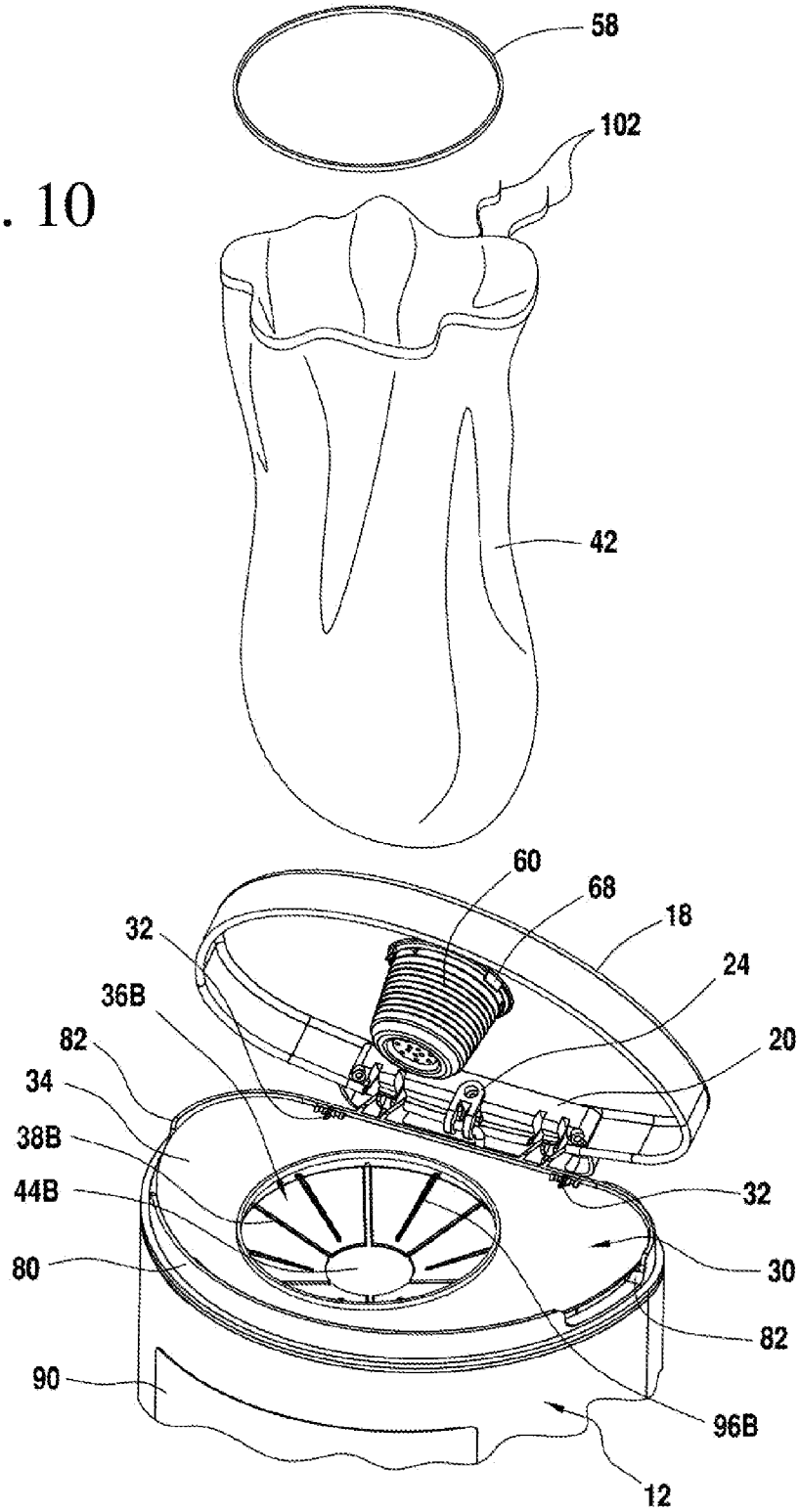
FIG. 10 is a perspective view of the container shown in FIG. 9 with the bag and hoop removed therefrom.
Figure 11:
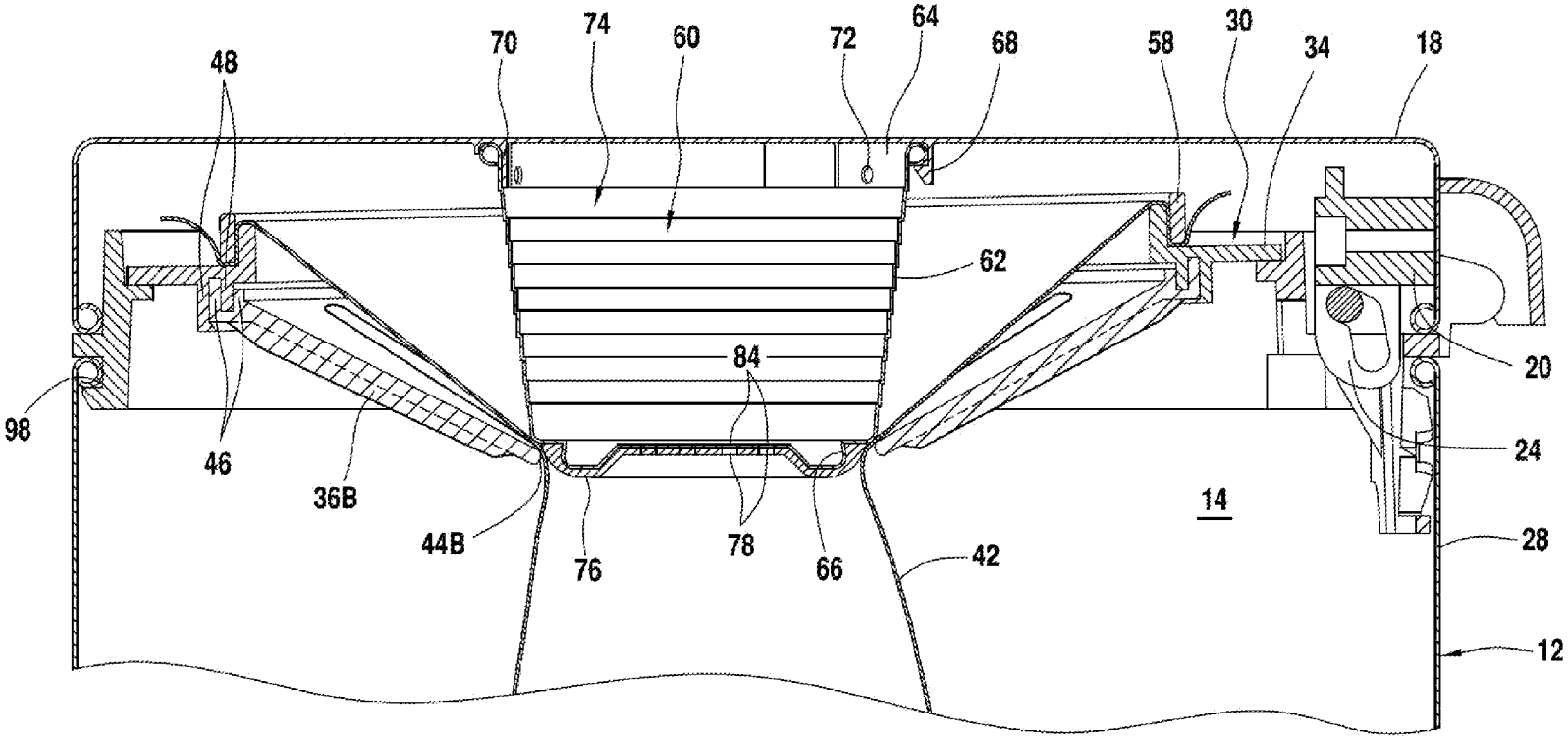
FIG. 11 is a cross-sectional view of a portion of the container shown in FIG. 9.

FIGS. 9-11 show another embodiment of container 10 wherein a door 90 is formed in the body 28 of the base 12. Door 90 is provided with a conventional attachment mechanism to enable it to be opened by pulling on a handle 92 and closed as desired, e.g., one or more hinges situated on the interior of the container 10. Door 90 also includes a window 94 that preferably extends vertically as shown to enable easy viewing of the condition of the bag 42 in the compartment 14 vis-à-vis its state of fullness. The window 94 is made of a clear or transparent material, e.g., plastic. By providing the window 94, a user has the option to view whether the bag 42 is full or not and based thereon, determine when it is appropriate to remove the bag 42 and replace it with a new bag 42.

Figure 28:
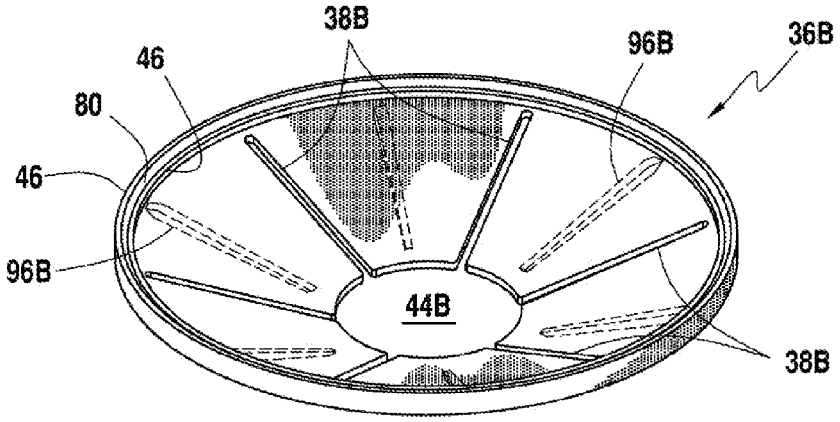

The container shown in FIGS. 9-11 also includes a membrane 36B differing from membranes 36 and 36A (see also FIG. 28). Membrane 36B has slots 38B that extend from the central opening 44B to almost the periphery of the membrane 36B and also supplemental slots 96B that extend radially inward from the periphery of the membrane 36B close to but separated from the central opening 44B. Supplemental slots 96B provide the membrane 36B with additional flexibility. Also, supplemental slots 96B may not extend fully through the thickness of the membrane 36B, i.e., have a height less than the height of the membrane 36B.

Otherwise, the container with membrane 36B is used in the same manner as container 10 with either of membranes 36, 36A, and membrane 36B may have the same characteristic and properties as membrane 36.

Figure 12:
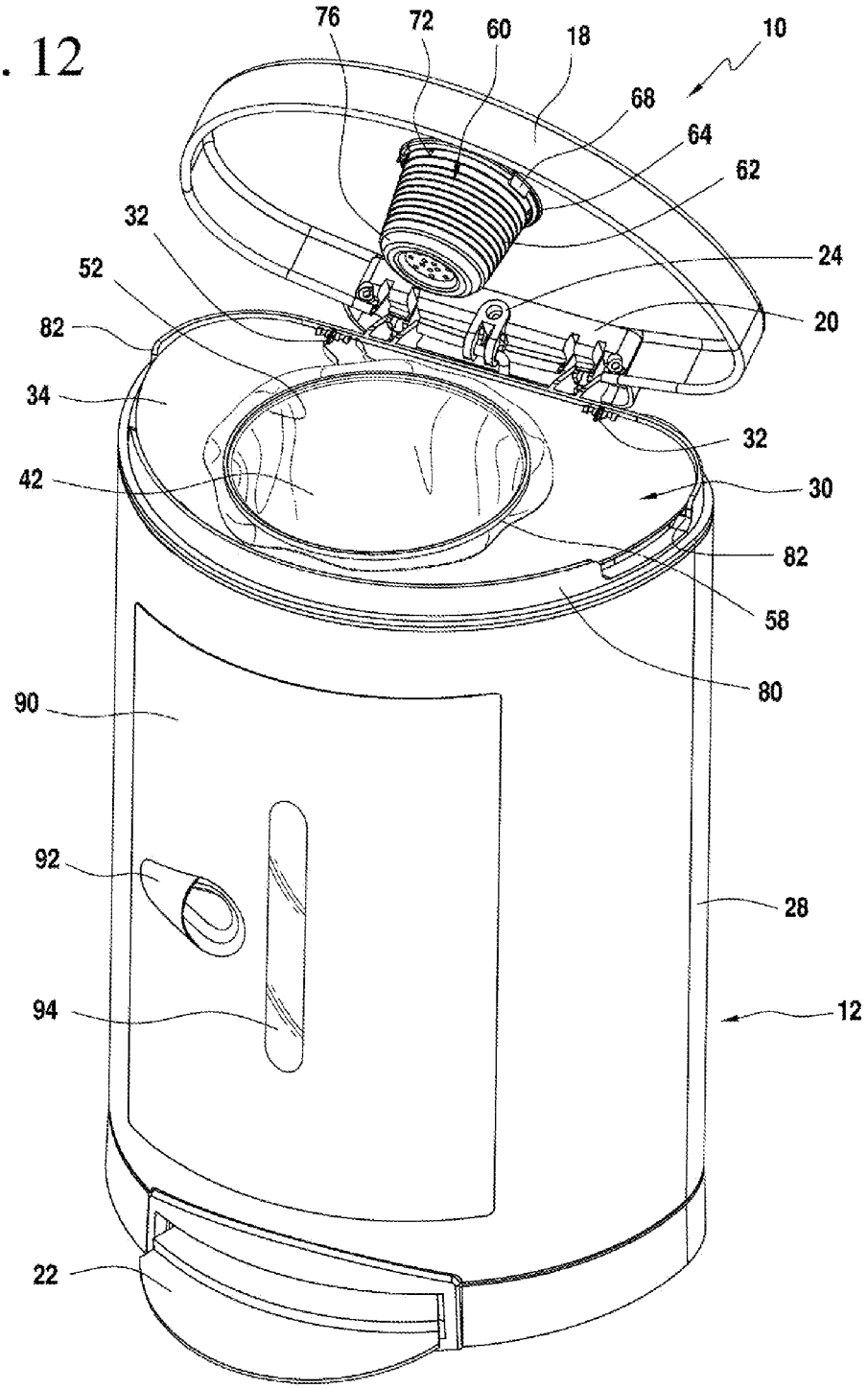
FIG. 12 is a perspective view of another embodiment of a waste container in accordance with the invention.
Figure 13:
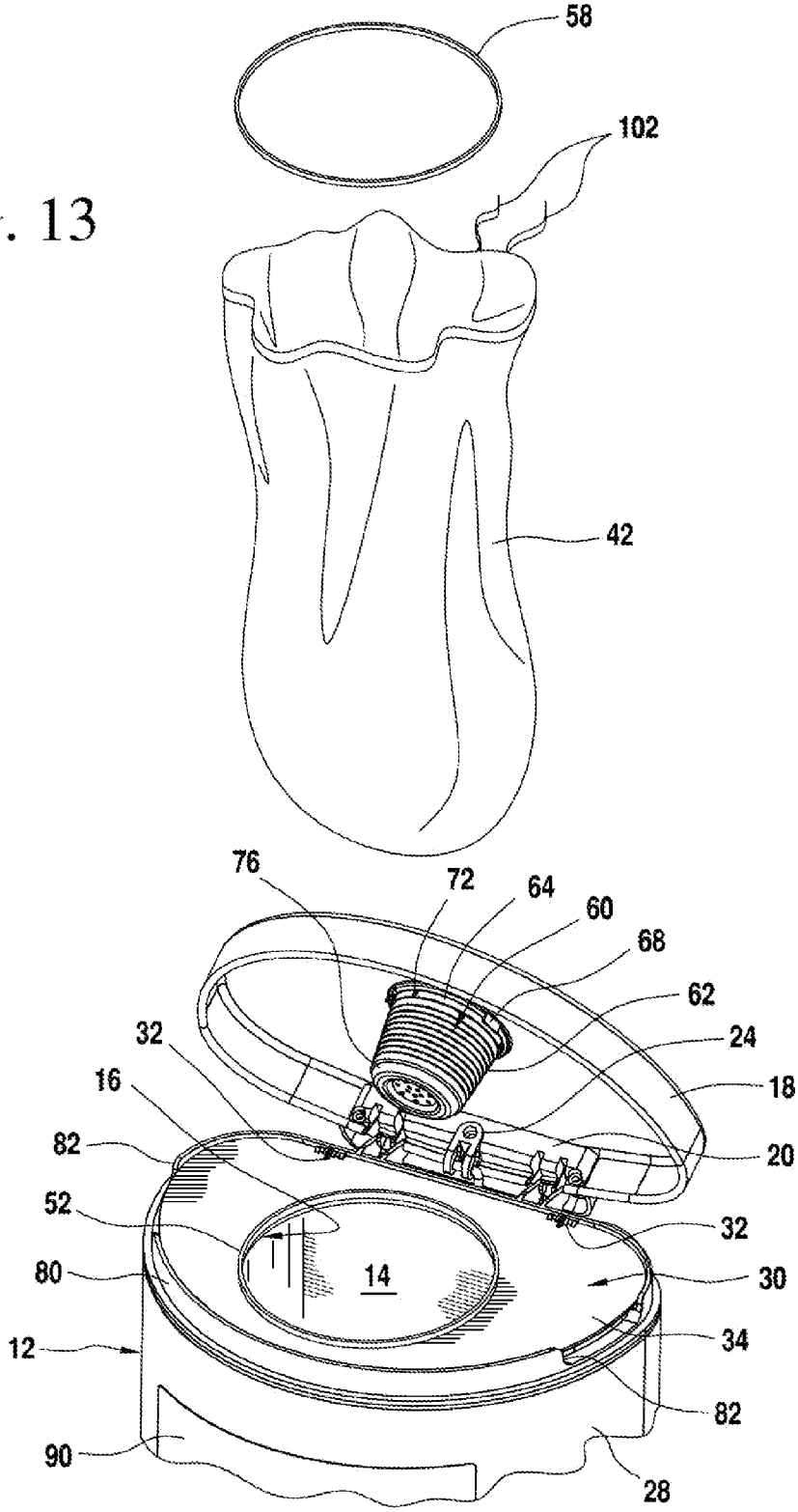
FIG. 13 is a perspective view of the container shown in FIG. 12 with the bag and hoop removed therefrom.
Figure 14:
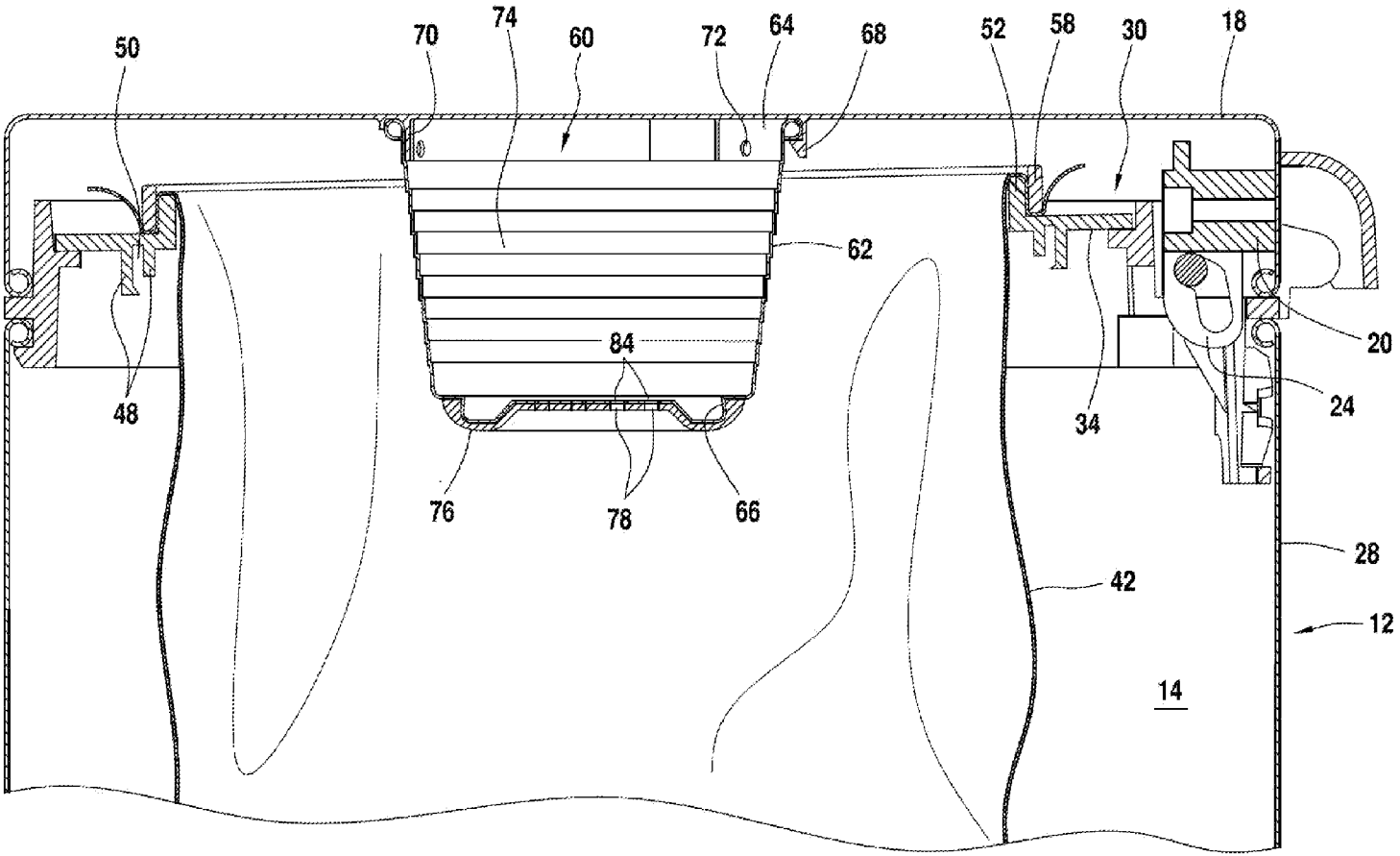
FIG. 14 is a cross-sectional view of a portion of the container shown in FIG. 12.

FIGS. 12-14 show another embodiment of container 10 wherein the closure component 30 does not retain a membrane, i.e., it is used without a membrane, and the container includes an optional side door 90 as shown in FIGS. 9-11. By virtue of the possible use of the container 10 without a membrane, the membrane is considered an optional feature. It may be attached to the closure component 30 when the user seeks to use the container for waste that is more easily insertable into the container with a membrane, yet then removed from the closure component 30 when the user seeks to use the container for waste that is more easily insertable into the container without a membrane.

In this embodiment, the base 62 of the waste treatment component 60 may be positioned such that the projections 68 on the underside of the lid 18 occlude the apertures 72 since there would be two sets of passages for deodorant or disinfectant to pass from the interior cavity 74 of the waste treatment component 60 to the bag 42, i.e., either through apertures 72 or through aligning apertures 78, 84.

The bag 42 of waste is removed from the compartment 14 either in the same manner as described above, i.e., through the top of the compartment 14 when the closure component is pivoted relative to the base 28, or simply by opening the door 90 to access the compartment 14.

Figure 15:
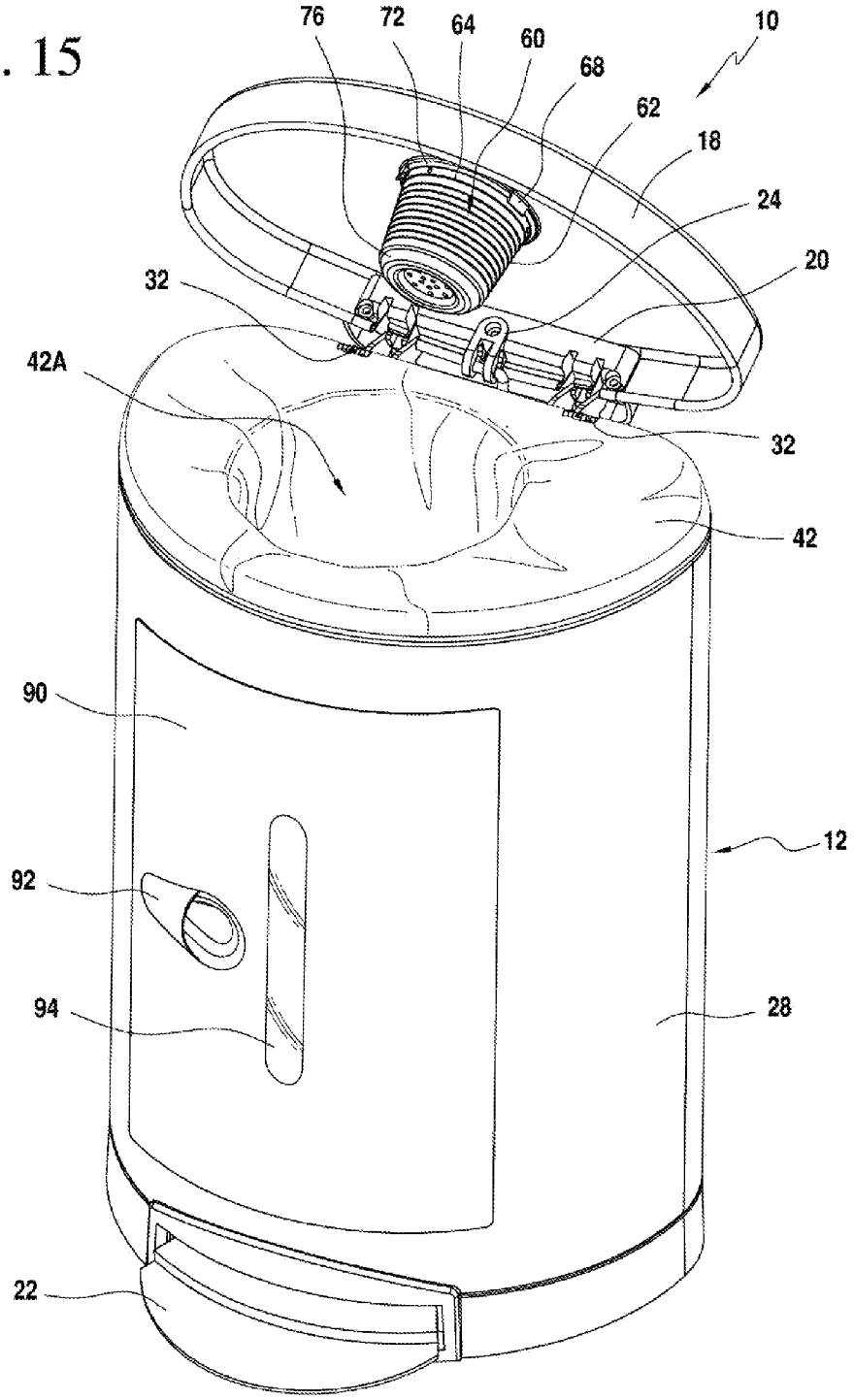
FIG. 15 is a perspective view of another embodiment of a waste container in accordance with the invention.
Figure 16:
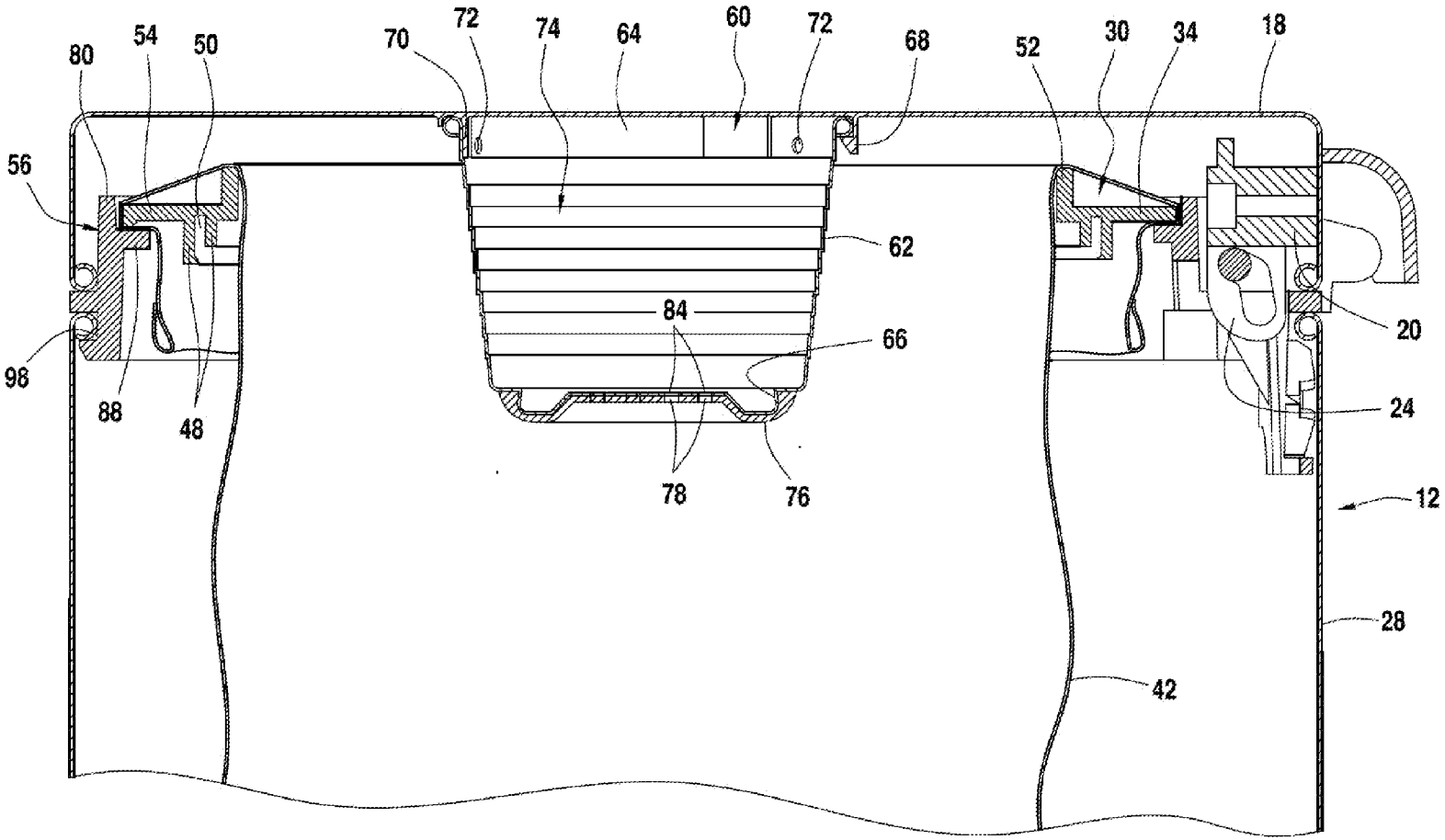
FIG. 16 is a cross-sectional view of a portion of the container shown in FIG. 14 with the lid in a closed state.
Figure 17:
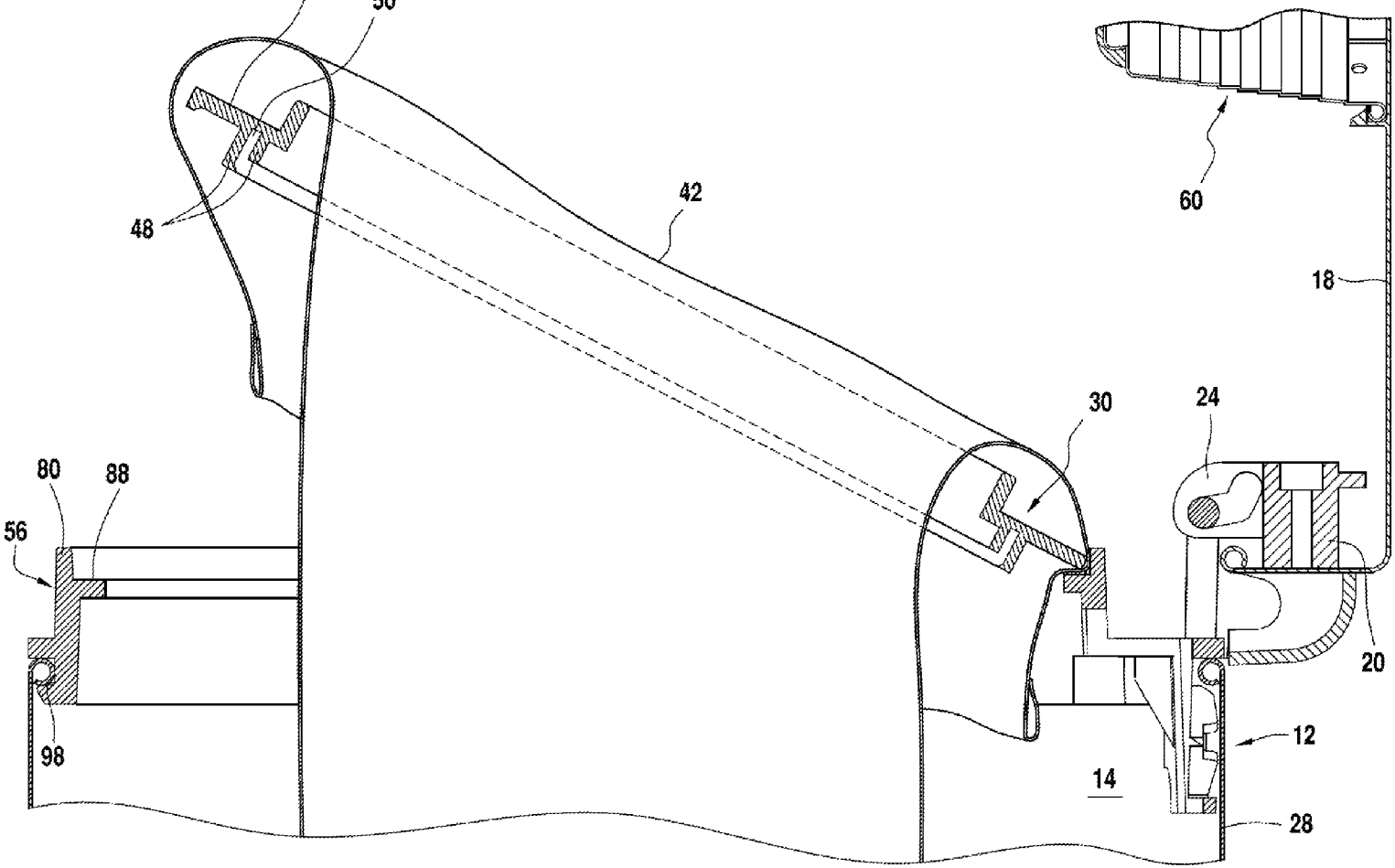
FIG. 17 is a cross-sectional view of a portion of the container shown in FIG. 14 with the lid in an open state.

FIGS. 15-17 show another embodiment of container 10 wherein the closure component 30 does not retain a membrane and is used without a hoop. The bag 42 may be placed through the opening 16 which is defined by the closure component 30 and then the flange of the bag 42 folded back on itself and around the support portion 34 of the closure component 30 (aside from the locations at which the hinges 32 are present (see FIG. 15 wherein the hinges 32 are visible when the bag 42 is in its use state). The bag 42 is thus secured between the inwardly projecting lip 58 of the closure component support portion 56 and the support portion 34 of the closure component 30 (see FIGS. 16 and 17).

In use, the container appears as shown in FIG. 15. The bag 42 is pressed downward into the compartment 14 until it is tightly drawn over the closure component 30.

Removal of the bag 42 when full is achieved, when the lid 18 is open, by lifting the front side of the closure component 30 upward relative to the hinged rear side to remove the flange of one part of the bag 42 from its securing between the closure component 30 and the closure component support portion 56 (see FIG. 17). The released flange of the bag 42 may then be inserted through the opening 16 and the closure component 30 removed to enable the flange of the bag 42 to be closed and lifted out of the compartment 14.

Figure 18:
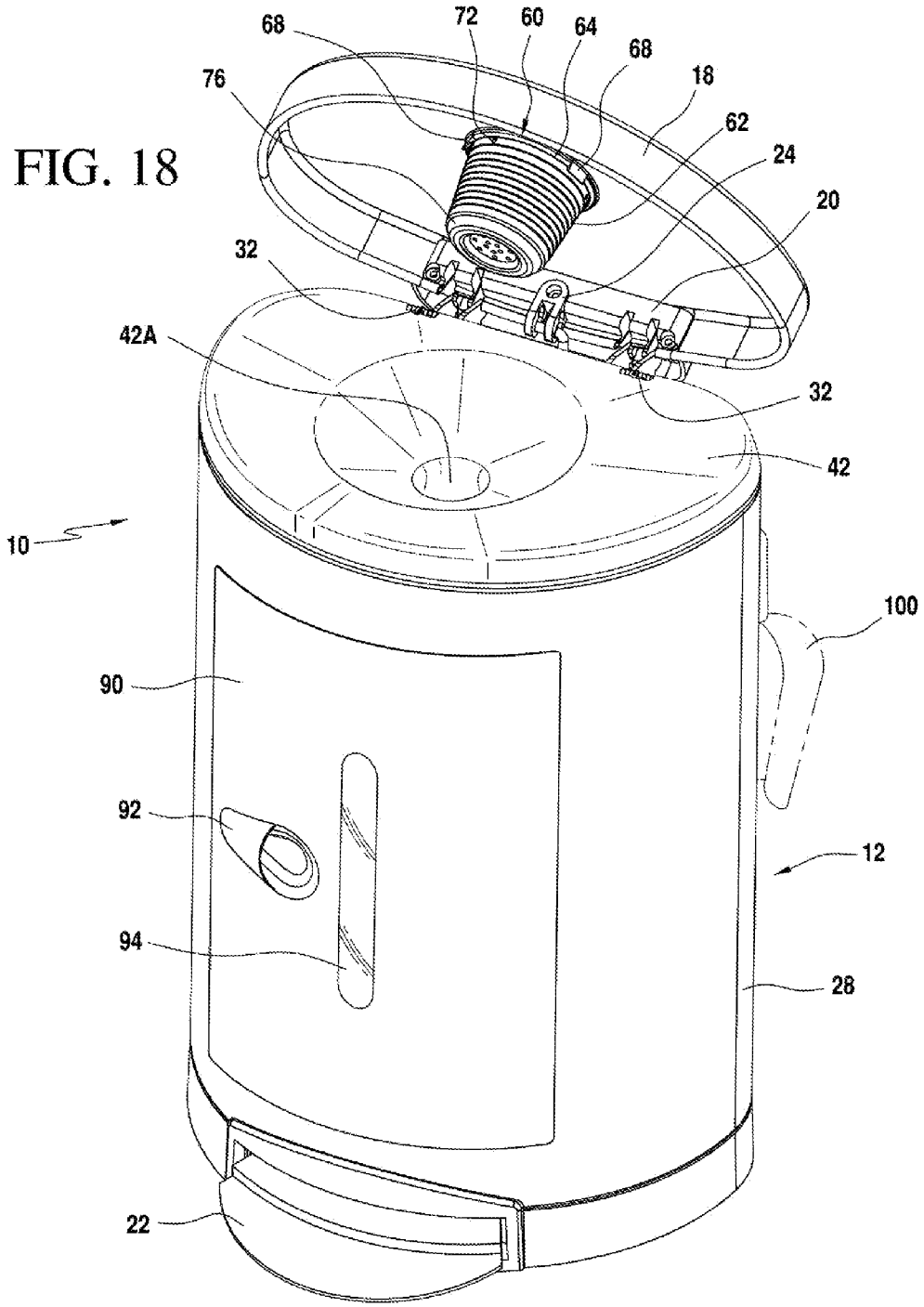
FIG. 18 is a perspective view of another embodiment of a waste container in accordance with the invention.
Figure 19:
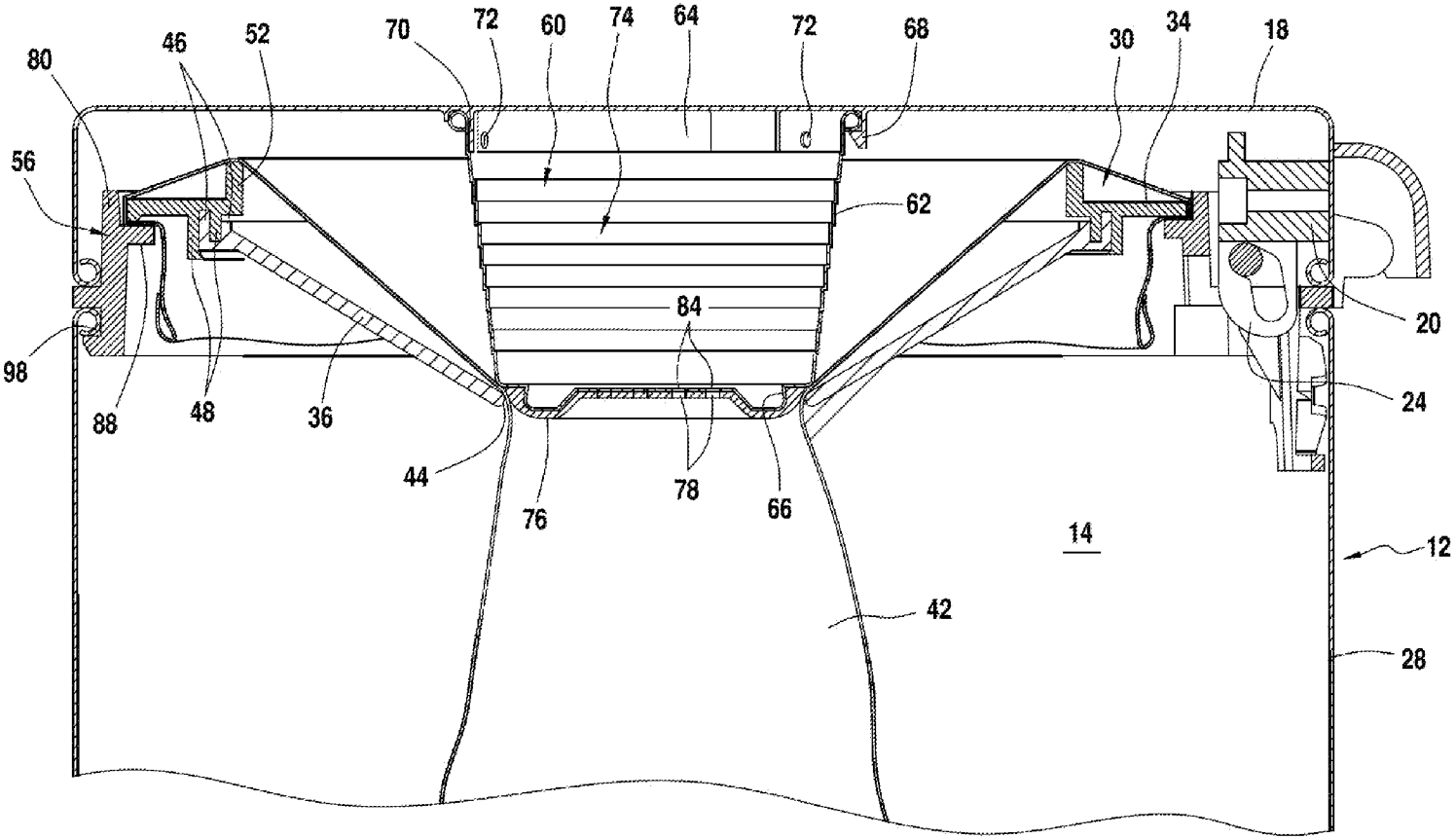
FIG. 19 is a cross-sectional view of a portion of the container shown in FIG. 18 with the lid in a closed state.

FIGS. 18 and 19 show another embodiment of container 10 wherein the closure component 30 retains a membrane 36 but is used without a hoop. As in the embodiment shown in FIGS. 15-17, the closure component 30 is pivotally attached to the base 12 of the container 10 via hinges 32 (see FIG. 18). For use, the bag 42 may be placed through the central opening 44 of the membrane 36 and then the flange of the bag 42 folded back on itself and around the support portion 34 of the closure component 30. The bag 42 and the closure component 30 are then placed on the closure component support portion 56 such that the bag 42 is secured between the inwardly projecting lip 58 of the closure component support portion 56 and the support portion 34 of the closure component 30 (see FIG. 19).

In use, the container appears as shown in FIG. 18 and is used in a similar manner as the container shown in FIGS. 15-17.

Figure 29:
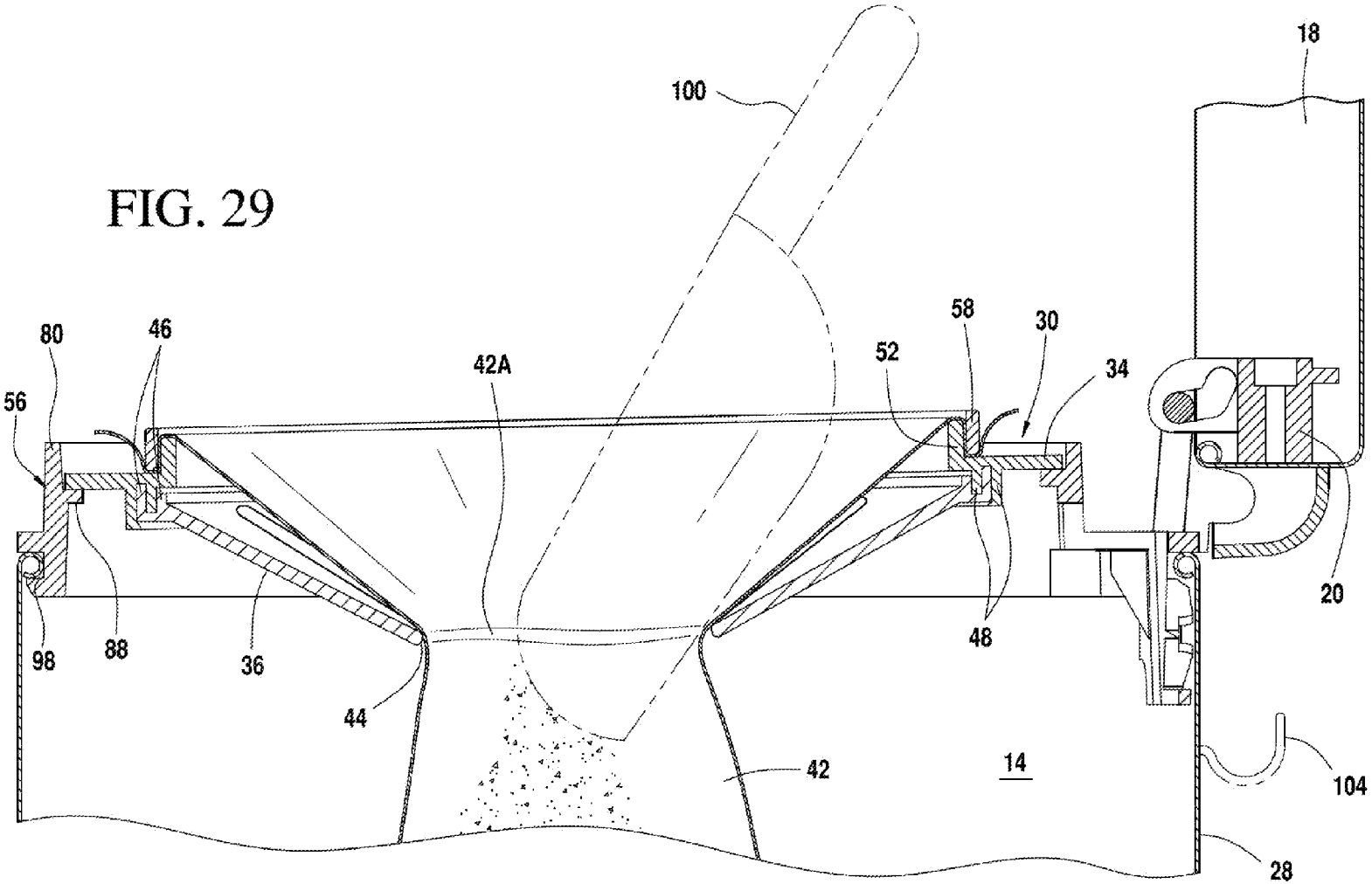
FIG. 29 is a view showing use of a container with a scoop that may be used to scoop cat litter into the bag.

Optionally, a scoop 100 is attached to a hook 104 on the body 28 of the base 12 (see FIGS. 18 and 29). Scoop 100 is particular useful when the container 10 is used for cat litter and other animal waste (although it may even be provided when the waste container is used for common household waste). The waste can be scooped up by the scoop 100 and deposited into the bag 42 on a portion that overlies the membrane 36, and more specifically, into the bag 42 around the central opening 44 of the membrane 36 (see FIG. 29). The tapered design of the scoop 100 can deflect the membrane 36 to temporarily allow for more litter, for example, to be inserted.

Instead of a scoop 100, another waste removal implement or tool may be provided, such as tongs, a large spoon, a magnet. As such, scoop 100 represents a generic waste removal implement or tool, i.e., waste removal facilitating means.

Figures 24, 25:
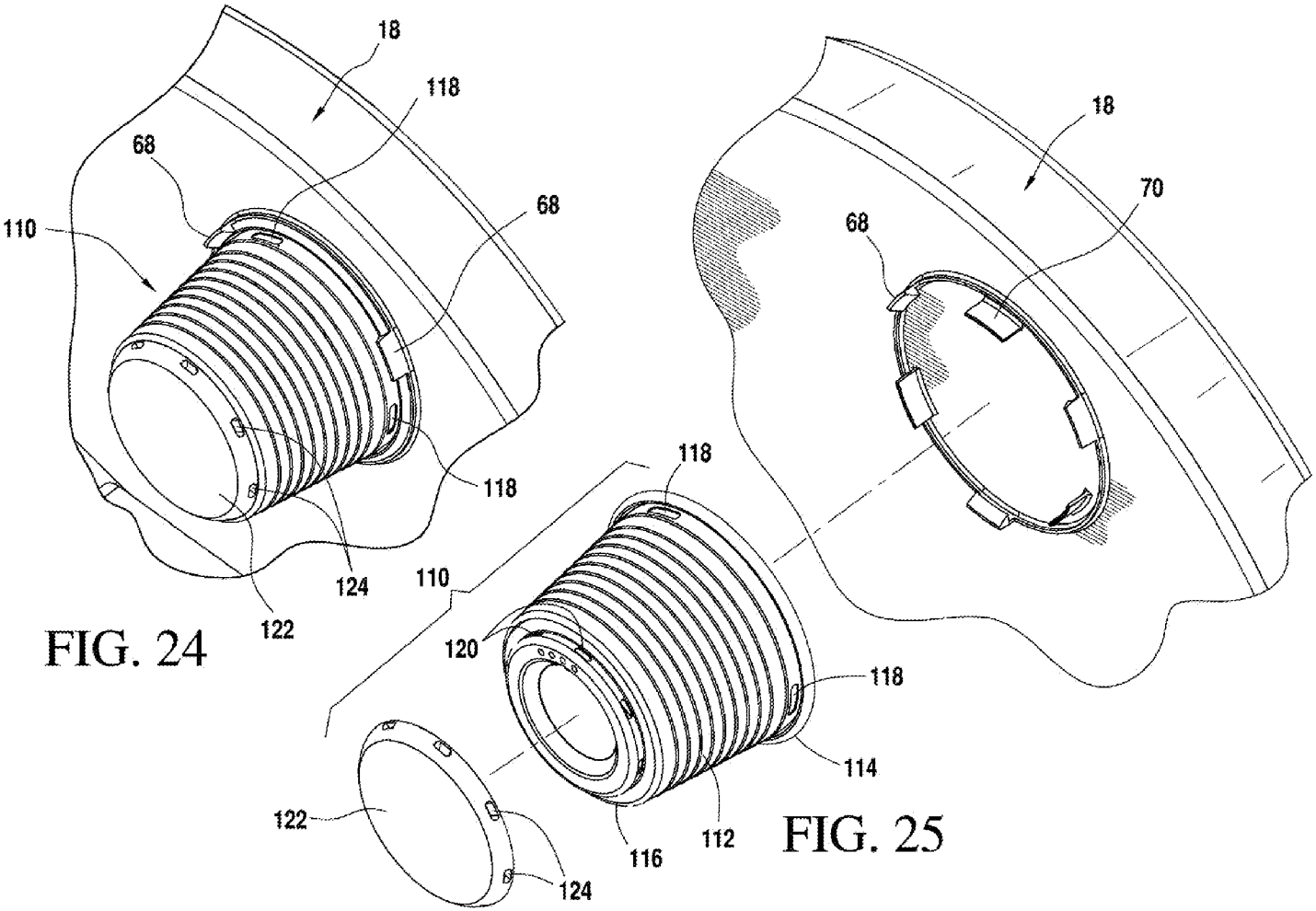
FIG. 24 is a perspective view of a second embodiment of a waste treatment component in accordance with the invention.
FIG. 25 is an exploded perspective view of the waste treatment component shown in FIG. 24.

Referring now to FIGS. 24 and 25, another embodiment of a waste treatment component that may be used in any of the embodiments disclosed herein is designated generally as 110 and includes a base 112 having an attachment portion 114 at an upper end and a conduit portion 116 at a lower end. Attachment portion 114 may comprise an enlarged rim that is designed to be positioned between projections 68, 70 on the underside of the lid 18 (see FIG. 25).

Also, attachment portion 114 includes apertures 118 that are preferably equal in number to the projections 68 and have the same circumferential spacing as the projections 68. In this manner, the waste treatment component 110 may be rotated to a position in which the projections 68 cover the apertures 118, and thereby prevent release of deodorant or disinfectant from an interior cavity of the waste treatment component 110 to the space between the bag 42 and the lid 18, or allow for release of deodorant or disinfectant from the interior cavity of the waste treatment component 110 to the space between the bag 42 and the lid 18 (this latter position being shown in FIG. 24). Rotation of the waste treatment component 110 can be effected manually depending on whether the user of the container 10 determines that there is a need to address unpleasant smells and odors between the bag 42 and the lid 18 or disinfect this area (or to neutralize bacteria, fungus, etc. or whatever treatment is being effected by the material in the waste treatment component 110). Rotation of waste treatment component 110 therefore controls the degree to which deodorant, disinfectant, air freshener, air purifier, antibacterial material, etc. is dispensed, released, distributed or disseminated into the space between the lid 18 and bag 42.

In contrast to the waste treatment component 60, in waste treatment component 110, the apertures 118 have a generally oval shape instead of a circular shape of apertures 72 (compare FIGS. 23 and 25). An oval shape for the apertures 118 generally allows for more deodorant, disinfectant or other waste treatment material in gaseous or powdered form, to pass therethrough.

Conduit portion 116 is formed as the bottom of the base 112 and includes a plurality of apertures 120 on a side surface through which deodorant or disinfectant from the interior cavity of the waste treatment component 110 is released to the interior of the bag 42 (see FIGS. 24 and 25). This is in contrast to waste treatment component 60 wherein the conduit portion 66 includes apertures 84 on a bottom surface (see FIG. 23). In further contrast, apertures 120 are oval shape as opposed to circular apertures 84 (see FIG. 25).

Release of deodorant or disinfectant is controlled by the user by a rotatable member 122 attached to the base 112 to selectively cover or expose the apertures 120 (see FIGS. 24 and 25). Rotatable member 122 includes oval-shaped apertures 124 that align with apertures 120 on the conduit portion 116 and/or solid portions of the conduit portion 116. There may be an equal number of apertures 124 as apertures 120 and they may have the same spacing to provide a relative positioning between the member 122 and the base 112 in which all of apertures 120 align with a respective aperture 124 (maximum outflow of waste treatment material) and a relative positioning between the member 122 and the base 112 in which all of apertures 120 are occluded by a solid portion of the member 122 (minimum or no outflow of waste treatment material).

One or more click stops may also be integrated into the waste treatment component 110 to guide the alignment of the apertures 124 relative to apertures 120. One embodiment includes four click stop detents that go from full opening (superimpose one over the other) to full closing.

Rotation of member 122 therefore controls the degree to which deodorant, disinfectant or other waste treatment material is released into the bag 42 from waste treatment component 110.

Member 122 may be provided with a bull nose or rounded face to facilitate pushing of waste through the bag aperture 42A. To this end, the waste treatment component mounting mechanism, i.e., projections 68, 70, are preferably positioned to align the member 122 with the central opening 44 of the membrane 36. Thus, during use of the container 10, any waste that is lodged in the bag 42 around the central opening 44 of the membrane 36 will be pushed by waste treatment component 110 into the portion of the bag 42 in the compartment 14 when the lid 18 is closed.

The presence of the bull nose on member 122 also improves the ability to clean the member 122 since it will likely come into contact with waste and be dirtied thereby during use of the container 10.

Instead of a removal mounting mechanism for the waste treatment component 110, a waste treatment component may be permanently attached to the underside of the lid 18.

Different constructions of a waste treatment component 110 are envisioned, in a similar manner as described above for waste treatment component 60.

Figure 30:
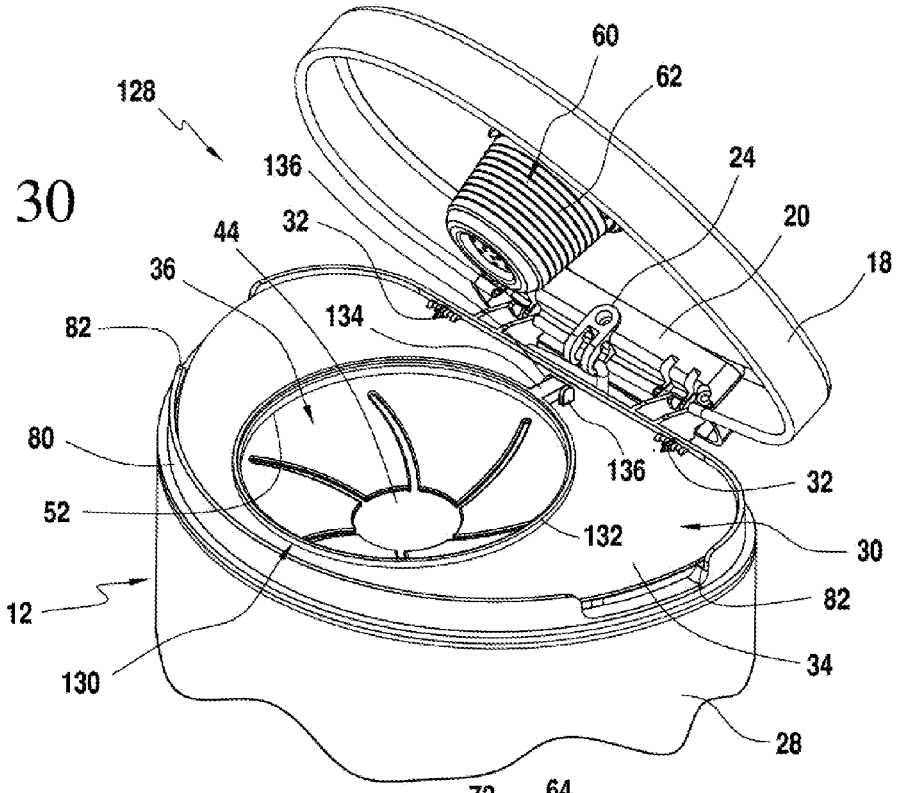
FIG. 30 is a partial view of a waste container in accordance with the invention showing a hoop is pivotally attached to the membrane support portion.

Referring now to FIG. 30, in this embodiment of a waste container, designated generally as 128, a hoop 130 is pivotally attached to the support portion 34 of the closure component 30 by a pivotal support mechanism, also referred to as pivotal mounting means. More specifically, the hoop 130 includes a substantially circular portion 132 and a flange 134 projecting outward from the circular portion 132, i.e., in a direction toward the rear side of the container as shown in FIG. 30. Two mounting projections 136 are arranged on the upper surface of the support portion 34. One or more pins (not shown) are then used to connect the flange 134 to the projections 136 to facilitate pivotal movement of the hoop 132 about a pivot axis defined by the pin(s).

This pivotal mounting of the hoop to the support portion 34, or more generally to the closure component 30, may be applied in any of the embodiments of a waste container disclosed herein.

It is possible to remove the hoop 132 from the projections 136 and store the hoop 132 on the underside of the lid 18, as described above. Thus, the waste container 128 may be used with or without the hoop 132. For example, different uses may be optimal for different sizes of the bag 42. For use with a relatively smaller bag, the hoop 132 would be installed and the bag secured between the hoop 132 and the projecting wall 58. For a relatively larger bag, the hoop 132 would be removed and the bag secured between the closure component 30 and the body 28, as described above.

Figure 31:
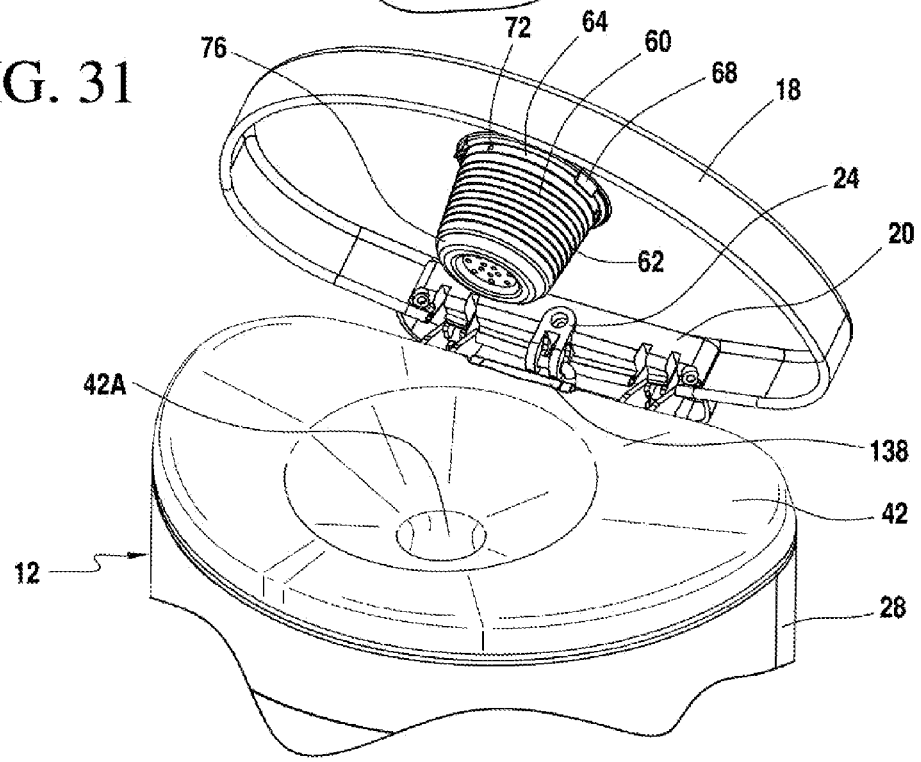
FIG. 31 is a partial view of a waste container in accordance with the invention showing a single hinge attached the membrane support portion to the base of the waste container.

Referring now to FIG. 31, another variation of the closure component 30 that may be applied to any of the embodiments of the waste container disclosed herein is to provide a single hinge 138 at the rear of the waste container. This single hinge 138 replaces the pair of spaced apart hinges 32 in some of the embodiments disclosed above. By providing a single hinge 138, instead of a pair of hinges 32, an advantage obtained when the bag 42 is installed is that the bag 42 may be more securely attached to the waste container 10 generally and more specifically to the closure component 30. Moreover, in this embodiment, the only pivotal connection between the body 28 and the closure component 30 is the single hinge 138, one part of which is connected to the body 28 and another, complementary part of which is connected to the closure component 30.

In the illustrated embodiments, the cross-sectional shape of the container taken in a horizontal plane when the container rests on a horizontal surface has a generally D-shape, i.e., may be referred to as a D-shaped container. The foot pedal 22 is situated at a central region of the curved edge of the D-shape and the lid mounting means are situated along the straight edge of the D-shape. The lid 18 therefore pivots about a horizontal axis extending in a direction substantially parallel to the straight edge of the container 10.

The waste containers in accordance with the invention optionally include a membrane which may be any of those shown in FIGS. 26-28. Each membrane 36, 36A, 36B may be used in any of the embodiments described herein, when a membrane is used (since some embodiments of the waste container described herein do not include a membrane). Alternatively, other membranes, such as disclosed in U.S. Pat. No. 8,215,089 (Stravitz) and U.S. Pat. No. 8,266,871 (Stravitz), both of which are incorporated by reference herein, may be used in the invention.

An advantage of the embodiments of the waste container described herein is that an inner liner for the base 12 is not required. Rather, the bag 42 serves as the liner for the base 12 and prevents waste from coming into contact with the inner surfaces of the body 28 of the base 12.

The type of bag 42 used in the containers disclosed herein may be any type of bag known to those in the waste disposal art. Any type of commercial garbage bag may be used. Deodorizing garbage bags may be used, e.g., a bag made of 7 layer EVOH and serves as an oxygen barrier. For some uses of the container 10, e.g., for cat litter and medical waste, it is preferable that the bag 42 not touch the bottom of the compartment 14 to allow for a cleaner funnel for gravity related substrates. This will insure a better tapered opening to receive the waste, especially as the bag 42 takes on weight from accumulating waste.

On the other hand. for waste that is urged into the bag aperture 42A, such as for example diapers, the bag can be longer to rest on the bottom of the compartment 14 or just touch the bottom, or be shorter than the bottom. The funneling (directing) and hands-free operations that are more necessary in cat litter and medical waste applications, are less prevalent for diaper disposal which requires urging or forced insertion of the waste through the bag aperture 42A and the central opening 44 of the membrane 36 into the portion of the bag 42 in the compartment 14.

If the bag 42 has a drawstring, the drawstring may be accessed and pulled to close the bag 42, either before or after the bag 42 is removed from engagement with the closure component 30 or membrane 36. In the former case, the pulled drawstring may be tied and then pushed into the compartment 14 so that when the closure component 30 is lifted up, the bag 42 is already closed. Alternatively, when a door 90 is provided, the door 90 may be opened to access and remove the closed bag 42.

The containers described above are not limited to use for any particular type of waste. The containers may be used for cat litter, diapers for children or adults, kitchen products, bathroom waste, medical waste, general waste and the like.

For medical use, it is possible to use the container in a hands-free mode whereby the user with medical waste uses their foot to open the lid 18 by depressing the foot pedal 22 and then drops the medical waste into the bag aperture 42A or along the portion of the bag 42 that overlies the funnel-shaped membrane 36. By the effect of gravity, the waste falls through the bag aperture 42A into the portion of the bag 42 in the compartment 14. For bio-hazardous waste, a red-colored bag 42 may be used. The lid 18 remains open as long as the user keeps their foot on the foot pedal 22. When pressure on the foot pedal 22 is released, the lid 18 closes and the waste treatment component 60, 110 forms a comfortable, temporary seal keeping bacteria and fungus and smell from migrating upward from the waste in the bag 42 in the compartment 14. This will prevent potentially harmful airborne fungus and bacteria from finding their way up to the inside top and edges of the lid 18, and thus prevent the release of these organisms to enter the room in which the container is situated and find their way up through vents in hospitals and nursing homes and doctor's offices, etc.

Thus, the waste treatment components 60, 110 when used in the container 10 in accordance with the invention provide three important functions, control of odor below the lid 18 (i.e., in the space between the lid 18 and the portion of the bag 42 that overlies the membrane 36), control of odor below the membrane 36 (inside the portion of the bag 42 in the compartment 14 in which waste is retained), and seal in offensive and potentially harmful odor when the lid 18 is closed. This combination of three features renders the container 10 including the waste treatment component 60, 110 extremely useful for all types of waste as described above.

An important feature of the invention that arises from the fact that the membrane 36 does not rotate relative to the base, as is common in some prior art waste disposal devices (e.g., in the U.S. patents mentioned above). Since the membrane 36 does not rotate, there is no restriction or limitation on the size and shape of the membrane 36, which are often present when a membrane has to rotate for operation of a waste disposal device.

Figure 32:
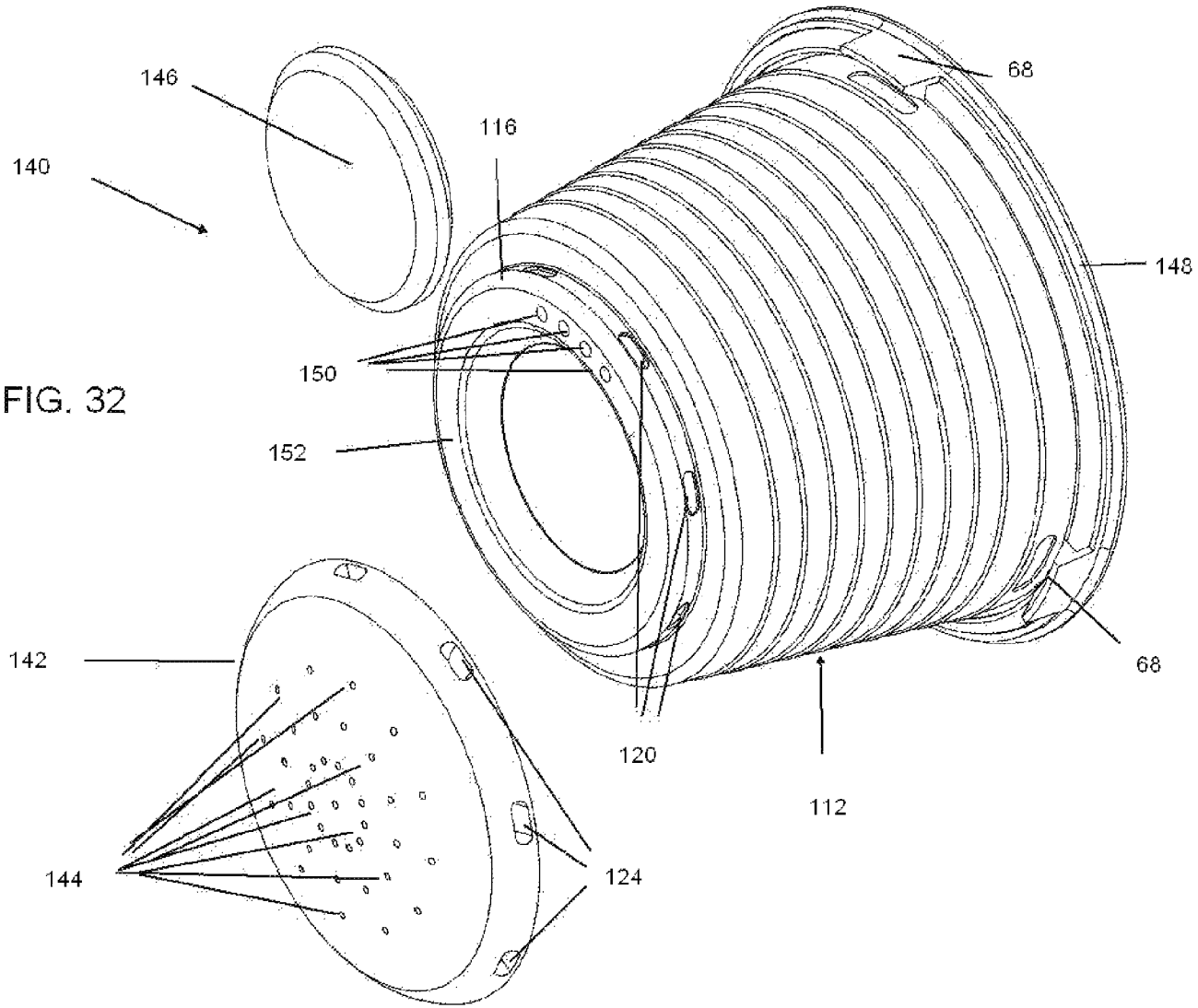
FIG. 32 is a perspective view of another embodiment of a waste treatment component in accordance with the invention.

Referring finally to FIG. 32, another embodiment of a waste treatment component 140 in accordance with the invention is shown. Waste treatment component 140 includes components similar to waste treatment component 110, namely the base 112 and a rotatable member 142 that is similar to rotatable member 122 except that it includes apertures 144. A gel bar 146 or other form of deodorant or disinfectant may be optionally positioned in the space between the conduit portion 116 of the base 112 and the rotatable member 142, and thus the apertures 144 facilitate enable release of the deodorant or disinfectant for gel bar 146.

Waste treatment component 140 can be a stand-alone unit, and to this end, includes a cover 148 that covers the open upper end of the base 112. Cover 148 includes the projections 68, 70 shown in FIG. 23 (the purpose, function and location of which are described above). Cover 148 is provided with an attachment device (not shown) to attach the cover 148, and thus the waste treatment component 140 when the base 112 is attached to the cover 148, to for example, the underside of a lid of a waste container. Since this embodiment is not required to be used for a waste container, the waste treatment component 140 can also be considered a deodorant or disinfectant and attached to other surfaces, whether a vertical surface in a closet or on a wall or a horizontal surface such as a ceiling or floor. The attachment device may be adhesive tape, hook and loop fasteners and the like.

Another advantage of this embodiment is that it is possible to place different compounds in the base 112 and between the base 112 and the rotatable member 142. Distribution of each compound is independent, i.e., distribution of the material of the gel bar 146 is through the apertures 144, and distribution of the compounds in the base 112 is through the aligning apertures 120, 124 and selectively closed apertures 118. Alternatively, a compound may be placed only in the upper compartment defined by the base 112, as described above, without use of the gel bar 146 Alternatively, it is possible to cause mixture of two compounds, with the compound in the upper compartment defined by the base 112 passing into the compartment defined between the base 112 and the rotatable member 142 through apertures (e.g., like apertures 84 defined in the bottom of the base 112 as shown in FIG. 23), mixing therewith and then being dispensed through apertures 144. Click stops 150 are formed in the rim 152 to control rotation of the member 142.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A waste container, comprising:

a base defining a waste-receiving compartment and including a body and a closure component, said closure component being pivotally attached to said body to provide said closure component with a first, open position in which said waste-receiving compartment is accessible and a second, closed position in which said waste-receiving compartment is closed, said closure component including a support portion, an opening and a membrane arranged in said opening and attached to said support portion such that said membrane moves with pivotal movement of said closure component between its first and second positions, said body including a closure component support portion that supports said closure component when in said second position;

a lid movably attached to said base and that moves between a first, closed position covering said opening of said closure component and a second, open position in which it does not obstruct said opening of said closure component; and a waste treatment component arranged on an underside of said lid, said waste treatment component being positioned to exert pressure at least partly toward said membrane when said membrane is present and when said lid is in its first position, said waste treatment component comprising:

a waste treatment component base having a conduit portion at a lower end having a solid part to thereby define a closed lower end of said waste treatment component base, and an open upper end, a cover attached to said waste treatment component base to close said open upper end, a first compartment receivable of a first waste treatment material being defined on a first side of said closed lower end of said waste treatment component base between said solid part of said conduit portion and said cover, and a member movably attached to said lower end of said conduit portion, a second compartment receivable of a second waste treatment material being defined, when said member is attached to said lower end of said waste treatment component base, on a second side of said closed lower end of said waste treatment component base opposite said first side and between said solid part of said conduit portion and said member, said member including at least one aperture on an exposed side in communication with said second compartment, whereby in use, a bag is partly inserted into said waste-receiving compartment through said membrane and retained by said closure component, and receives waste.

2. The container of claim 1, wherein said waste treatment component base further includes an attachment portion at said upper end at which said waste treatment component base is attached to said lid, said conduit portion including at least one aperture in communication with said first compartment, said movable member including additional apertures that selectively align with said at least one aperture in said conduit portion upon movement of said movable member relative to said waste treatment component base.

3. The container of claim 2, wherein said lid includes two sets of projections, said waste treatment component base being attached to said lid by engaging said attachment portion between said projections.

4. The container of claim 3, wherein said attachment portion includes apertures equal in number to one of said sets of projections that is radially outward of said attachment portion when said waste treatment component is attached to said lid, said waste treatment component being rotatable to cause said projections to selectively expose or occlude said apertures on said attachment portion.

5. The container of claim 2, wherein said additional apertures in said movable member are oval-shaped.

6. The container of claim 2, wherein said at least one aperture in said conduit portion is in a side face of said waste treatment component base, said movable member having a rounded bottom portion and a side face including said additional apertures of said movable member.

7. The container of claim 1, wherein said at least one aperture of said member comprises a plurality of apertures in a bottom-facing surface opposite said solid part of said conduit portion.

8. The container of claim 1, wherein said membrane is flexible and includes a central opening and a plurality of slots defining fingers around said central opening.

9. The container of claim 1, wherein said membrane is integral with said support portion or removably attached to said support portion.

10. The container of claim 8, wherein said slots extend from said central opening to a periphery of said membrane, said membrane further comprising supplemental slots that extend radially inward from the periphery of said membrane close to but separated from said central opening.

11. The container of claim 1, wherein said closure component support portion includes an inwardly projecting lip on which a peripheral edge of said support portion of said closure component rests when in the second position.

12. The container of claim 1, wherein said closure component support portion includes a peripheral wall having at least one cut-out portion to facilitate movement of said closure component from the second position to the first position.

13. The container of claim 1, further comprising a hoop for securing the bag to said closure component.

14. The container of claim 13, wherein said hoop is pivotally attached to said support portion of said closure component.

15. The container of claim 1, further comprising attachment means for pivotally attaching said closure component to said body.

16. The container of claim 15, wherein said attachment means comprise a pair of hinges spaced apart from one another, one portion of each of said hinges being attached to said body and a complementary portion of each of said hinges being attached to said closure component.

17. The container of claim 15, wherein said attachment means consists of a single hinge, one portion of said hinge being attached to said body and a complementary portion of said hinge being attached to said closure component.

18. The container of claim 1, further comprising a depressible pedal coupled to said lid for controlling movement of said lid between said first and second positions.

19. The container of claim 1, wherein said base includes a door on a side that provides access to said waste-receiving compartment, said door including a window made of a clear or transparent material.

20. The container of claim 1, wherein said conduit portion includes a rim and click stops formed on said rim to control rotation of said movable member relative to said waste treatment component base.

21. The container of claim 1, wherein said conduit portion includes at least one aperture in communication with said first compartment in a side face of said waste treatment component base, said movable member including additional apertures in a side face that selectively align with said at least one aperture in said conduit portion upon movement of said movable member relative to said waste treatment component base.

* * * * *